US007763784B2

(12) United States Patent
Luttwak

(10) Patent No.: US 7,763,784 B2
(45) Date of Patent: Jul. 27, 2010

(54) STRINGED MUSICAL INSTRUMENTS AND METHODS OF MAKING THEREOF

(76) Inventor: Joseph E. Luttwak, 1736 Grove St., San Francisco, CA (US) 94117

( * ) Notice: Subject to any disclaimer, the term of this patent is extended or adjusted under 35 U.S.C. 154(b) by 0 days.

(21) Appl. No.: 12/352,352

(22) Filed: Jan. 12, 2009

(65) Prior Publication Data

US 2009/0183618 A1 Jul. 23, 2009

Related U.S. Application Data

(63) Continuation-in-part of application No. 11/968,618, filed on Jan. 2, 2008.

(60) Provisional application No. 60/883,200, filed on Jan. 3, 2007.

(51) Int. Cl.
*G10D 3/00* (2006.01)

(52) U.S. Cl. ..... 84/291; 84/267

(58) Field of Classification Search ..... 84/267, 84/291; D17/14, 20
See application file for complete search history.

(56) References Cited

U.S. PATENT DOCUMENTS

| | | | | | |
|---|---|---|---|---|---|
| 168,665 | A | * | 10/1875 | Oehrlein | 84/291 |
| 518,775 | A | * | 4/1894 | Birrer | 84/267 |
| 523,079 | A | * | 7/1894 | Malkemus | 84/267 |
| 536,846 | A | * | 4/1895 | Bates | 84/298 |
| 549,966 | A | * | 11/1895 | Hutchins | 84/292 |
| 555,651 | A | * | 3/1896 | Merrill | 84/267 |
| D26,043 | S | * | 9/1896 | Knutsen | D17/18 |
| 586,032 | A | * | 7/1897 | Hartmann | 84/295 |
| D28,300 | S | * | 2/1898 | Knutsen | D17/18 |
| D29,666 | S | * | 11/1898 | Hagberg | D17/14 |
| 636,692 | A | * | 11/1899 | Patch | 84/291 |
| 647,173 | A | * | 4/1900 | Almcrantz | 84/293 |

(Continued)

FOREIGN PATENT DOCUMENTS

DE 196 40 278 A1 4/1998

OTHER PUBLICATIONS

Goodwinds.com catalog, merchant for structural tubing, carbon and fiberglass, search for "tube" © 2003-2009 viewed Nov. 12, 2009 at www.goodwinds.com.*

(Continued)

*Primary Examiner*—Jeffrey Donels
*Assistant Examiner*—Robert W Horn
(74) *Attorney, Agent, or Firm*—Kang S. Lim

(57) ABSTRACT

An improved stringed musical instrument includes a unitary shell having a head, a neck and a body. The unitary shell has an asymmetrical waist having a substantially flat side and a substantially concave side. The instrument also includes a soundboard configured to be attached to the unitary shell. The soundboard includes a body portion having a sound hole located substantially adjacent the substantially flat side of the waist of the unitary shell. The union of the unitary shell and the soundboard results in the formation of a substantially hollow cavity in the unitary shell, with the hollow cavity acoustically coupled to the sound hole. In some embodiments, the hollow cavity extends through the head, the neck and the body, with an optional supplemental sound hole positioned at the head. The instrument can be strengthened by one or more reinforcing structures strategically located on the interior surfaces of the body, neck and/or soundboard.

19 Claims, 34 Drawing Sheets

U.S. PATENT DOCUMENTS

| | | | | | |
|---|---|---|---|---|---|
| D33,685 | S | * | 12/1900 | Behee | D17/19 |
| 812,049 | A | * | 2/1906 | Krueger | 84/267 |
| 977,127 | A | * | 11/1910 | Rengert et al. | 84/293 |
| D45,566 | S | * | 4/1914 | Longobardi | D17/14 |
| 1,183,369 | A | * | 5/1916 | Gardie | 84/263 |
| 1,304,914 | A | * | 5/1919 | Smith | 84/291 |
| D77,401 | S | * | 1/1929 | Elliott | D17/19 |
| 1,733,595 | A | * | 10/1929 | Greenfield | 84/267 |
| D80,575 | S | * | 2/1930 | Merkel | D17/14 |
| 1,834,804 | A | * | 12/1931 | Puoina | 84/267 |
| 2,449,124 | A | * | 9/1948 | Kimmons | 84/267 |
| 3,561,314 | A | * | 2/1971 | MacEachron | 84/284 |
| 4,126,072 | A | * | 11/1978 | Taylor | 84/173 |
| 4,144,793 | A | * | 3/1979 | Soika et al. | 84/291 |
| 4,145,948 | A | | 3/1979 | Turner | |
| D253,352 | S | | 11/1979 | Kaman | |
| 4,200,023 | A | | 4/1980 | Kaman | |
| 4,213,370 | A | * | 7/1980 | Jones | 84/291 |
| 4,290,336 | A | | 9/1981 | Peavey | |
| 4,313,362 | A | | 2/1982 | Lieber | |
| 4,317,402 | A | * | 3/1982 | McPherson, Sr. | 84/291 |
| 4,353,862 | A | | 10/1982 | Kaman, II | |
| 4,359,923 | A | * | 11/1982 | Brunet | 84/267 |
| 4,364,990 | A | | 12/1982 | Haines | |
| 4,408,516 | A | | 10/1983 | John | |
| 4,429,608 | A | * | 2/1984 | Kaman et al. | 84/291 |
| 4,846,039 | A | | 7/1989 | Mosher | |
| 4,873,907 | A | * | 10/1989 | Decker et al. | 84/291 |
| 4,969,381 | A | * | 11/1990 | Decker et al. | 84/291 |
| 5,333,527 | A | | 8/1994 | Janes et al. | |
| 5,537,906 | A | * | 7/1996 | Steinberger | 84/291 |
| 5,895,872 | A | | 4/1999 | Chase | |
| 5,911,168 | A | | 6/1999 | Enserink | |
| 5,922,979 | A | * | 7/1999 | Yui | 84/291 |
| 5,955,688 | A | * | 9/1999 | Cook | 84/291 |
| 6,060,650 | A | * | 5/2000 | McPherson | 84/291 |
| 6,087,568 | A | | 7/2000 | Seal | |
| 6,103,961 | A | * | 8/2000 | Kaufman | 84/291 |
| 6,107,552 | A | * | 8/2000 | Coomar et al. | 84/291 |
| 6,255,566 | B1 | | 7/2001 | Bly | |
| 6,372,970 | B1 | * | 4/2002 | Saunders et al. | 84/293 |
| 6,538,183 | B2 | * | 3/2003 | Verd | 84/291 |
| 6,608,247 | B2 | * | 8/2003 | Bryan | 84/291 |
| 6,610,915 | B2 | | 8/2003 | Schleske | |
| 6,664,452 | B1 | | 12/2003 | Teel | |
| 6,683,236 | B2 | * | 1/2004 | Davis et al. | 84/291 |
| 6,693,233 | B1 | * | 2/2004 | Sewell | 84/291 |
| D489,395 | S | * | 5/2004 | Sewell | D17/14 |
| 6,770,804 | B2 | | 8/2004 | Schleske | |
| 6,943,283 | B2 | * | 9/2005 | McPherson | 84/291 |
| D522,041 | S | * | 5/2006 | Sewell | D17/14 |
| D530,358 | S | * | 10/2006 | Giannini | D17/14 |
| 7,151,210 | B2 | * | 12/2006 | Janes et al. | 84/291 |
| D536,724 | S | * | 2/2007 | Cupit | D17/14 |
| 7,446,247 | B2 | * | 11/2008 | Shellhammer | 84/291 |
| 7,514,615 | B2 | * | 4/2009 | Ribbecke | 84/294 |
| 7,579,534 | B1 | * | 8/2009 | Ryan | 84/291 |
| 2002/0104423 | A1 | * | 8/2002 | Verd | 84/291 |
| 2003/0070528 | A1 | | 4/2003 | Davis et al. | |
| 2008/0110318 | A1 | * | 5/2008 | Fox | 84/267 |
| 2008/0156168 | A1 | * | 7/2008 | Luttwak | 84/267 |
| 2009/0049976 | A1 | * | 2/2009 | Starr | 84/267 |
| 2009/0183618 | A1 | * | 7/2009 | Luttwak | 84/291 |

OTHER PUBLICATIONS

Goodwinds.com catalog, merchant for structural tubing, carbon and fiberglass, search for "tapered" © 2003-2009, viewed 11/16.com at www.goodwinds.com.*

* cited by examiner

STRINGED MUSICAL INSTRUMENTS AND METHODS OF MAKING THEREOF

REFERENCE TO RELATED APPLICATIONS

This continuation-in-part application claims the benefit of U.S. Provisional Application Ser. No. 60/883,200, filed Jan. 3, 2007, and U.S. non-provisional application Ser. No. 11/968,618, entitled "STRINGED MUSICAL INSTRUMENTS AND METHODS OF MAKING THE SAME", filed Jan. 2, 2008 by Joseph E. Luttwak, which are both incorporated by reference herein in their entirety.

BACKGROUND

This invention relates stringed musical instruments, such as guitars, and methods for making such stringed instruments.

Stringed instruments traditionally have been constructed of wood, but also have been fabricated from plastics, molded composite materials, and combinations of such materials. As shown in FIG. 1, a conventional stringed instrument typically includes a body 10, a neck 12, a head 14 (sometimes called a "headstock"), a soundboard 16, a fingerboard 18 (sometimes called a "fretboard"), strings 20, a bridge 22 and a sound hole 24. In acoustic stringed instruments the interior of body 10 is hollow, and forms a resonant cavity, often called a "sound chamber." In acoustic stringed instruments, the vibration of strings 20 is transmitted through bridge 22 to the body via soundboard 16. In turn, the vibration of soundboard 16 vibrates air inside the sound chamber, and produces the sound that is projected from sound hole 24.

In many conventional stringed instruments, the various components are constructed separately, and then joined to form a finished instrument. Because the structural integrity of a stringed instrument affects the tonal quality and sound output of the instrument, stringed instruments made from separately joined parts experience some loss in sound quality. In addition, in many conventional stringed instruments, the neck 12 and head 14 are made of solid material, which decreases the volume and tonal range of the instrument because the added weight dampens resonance. Generally speaking, a lighter instrument is better than a heavier one as long as stiffness is substantially similar. The most expensive and resonant guitars typically are very light and also very stiff relative to their weight. Further, solid neck and head components reduce the "sustain" of the instrument—that is, the length of time that the strings "ring" when played.

Small-bodied stringed instruments, such as small-bodied acoustic guitars designed for travel, are particularly susceptible to sound degradation attributable to design and manufacturing considerations. In particular, small-bodied stringed instruments typically have a relatively small sound chamber, and thus have reduced volume and tonal range compared with that of normal-sized stringed instruments. The sound degradation for small-bodied stringed instruments is further exacerbated by use of a solid neck. In addition, a common problem with small-bodied acoustic guitars is that the solid neck is heavier than the hollow body, which requires the user to awkwardly elevate the neck to play the instrument.

Some designers and manufacturers have sought to improve sound quality or structural integrity of stringed instruments by providing a hollow neck that forms an enclosed passage that communicates with the sound chamber and one or more sound holes located at the headstock. Such "expanded sound chamber" designs benefit from the continuous hollow sound chamber between the body and neck. However, such previously known designs typically are fabricated from numerous separate components that must be attached to form the finished instrument. Thus, the improvement in sound quality resulting from the expanded sound chamber is offset by the lack of structural integrity and resulting degradation in sound quality attributable to construction from separate parts.

As an alternative approach, some designers and manufacturers have sought to improve sound quality or structural integrity of stringed instruments by fabricating instruments using so-called "one-piece" designs that reduce the number of separate components that must be joined to form the finished instrument. Although such "unitary" stringed instruments offer some improvements over conventional designs, they each suffer from significant drawbacks that negatively impact sound quality and/or manufacturability.

Indeed, some form of unitary stringed instruments appeared in the late $19^{th}$ century. Such instruments were typically constructed of wood, were extremely time-consuming to manufacture, and were very fragile. More recently, guitar designers and manufacturers have created molded unitary stringed instruments using composite and/or injection-molding techniques. However, such molded unitary stringed instruments typically include numerous shortcomings, and/or fail to provide an instrument that is designed for optimal resonance and superior sound quality.

For example, some previously known "unitary" stringed instruments are actually use a separate neck that must be attached to a unitary body, which defeats the benefits gained from unitary construction techniques. Other prior art unitary stringed instruments use a neck that is strengthened using internal assemblies that make the instrument very heavy and thus reduces the resonance of the instrument. Some previously known stringed instruments are fully unitary, but include rigid soundboards that are not suitable for acoustic stringed instruments.

Some prior art stringed instruments have attempted to combine the benefits of unitary construction and expanded sound chamber design. However, such "combination" designs fail to achieve an instrument that is easy to manufacture, structurally sound and highly resonant.

It is therefore apparent that an urgent need exists for improved stringed instruments that produces similar sounds as traditional wooden instruments, is easy to manufacture and maintain, less sensitive changes in temperature and humidity, shock and impact resistant, portable, cost effective, and have long life.

SUMMARY

To achieve the foregoing and in accordance with the present invention, stringed instruments substantially made from synthetic materials and methods for manufacturing thereof are provided. Such instruments are sturdy, reliable, playable and without the many disadvantages of traditional wooden instruments.

In one embodiment the stringed instrument includes a unitary shell having a head, a neck and a body. The unitary shell has an asymmetrical waist having a substantially flat side and a substantially concave side. The instrument also includes a soundboard configured to be attached to the unitary shell. The soundboard includes a body portion having a sound hole located substantially adjacent the substantially flat side of the waist of the unitary shell.

The union of the unitary shell and the soundboard results in the formation of a substantially hollow cavity in the unitary shell, with the hollow cavity acoustically coupled to the sound hole. In some embodiments, the hollow cavity extends through the head, the neck and the body, with an optional supplemental sound hole positioned at the head.

The unitary shell can be strengthened by one or more reinforcing structures, such as tubes and/or plates, strategically located on the interior surfaces of the body and neck. The soundboard can be similarly strengthened by one or more reinforcing structures, such as tubes and/or plates, selectively attached to stressed portions. Since the unitary shell and the soundboard can be manufactured using synthetic materials, it is also possible to integrate reinforcing structures within the shell or soundboard.

These and other features of the present invention will be described in more detail below in the detailed description of the invention and in conjunction with the following figures.

BRIEF DESCRIPTION OF THE DRAWINGS

In order that the present invention may be more clearly ascertained, one embodiment will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention. The features and advantages of the present invention may be better understood with reference to the drawings and discussions that follow.

Figure 1:
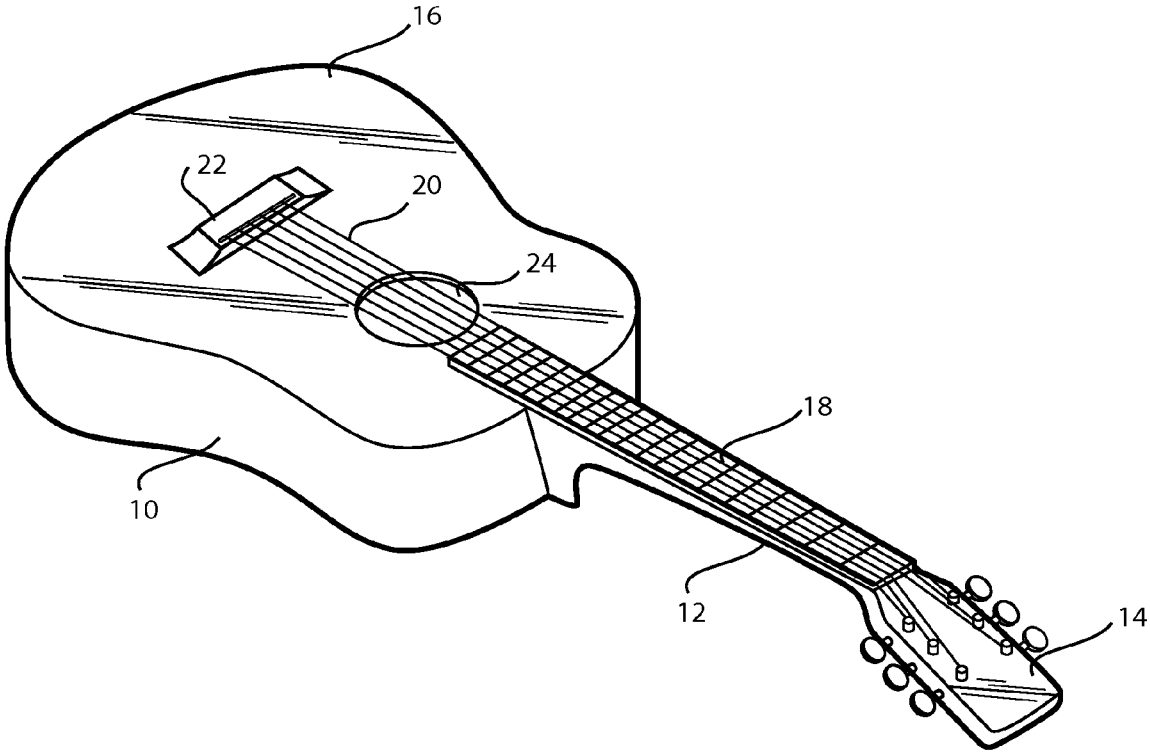
FIG. 1 (PRIOR ART)
FIG. 1 is perspective view of a conventional stringed instrument.
Figure 2A:
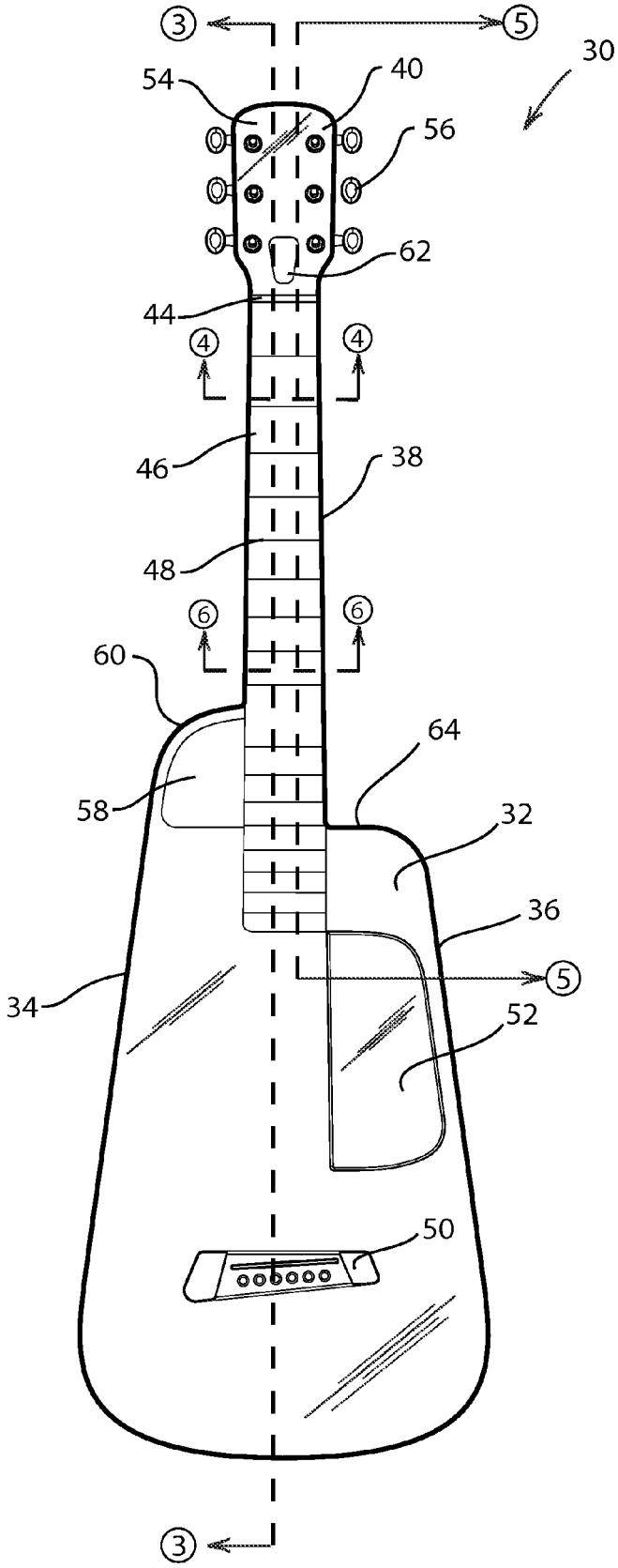
FIGS. 2A-2D are top plan view, left perspective view, right perspective view, and bottom plan view, respectively, of an exemplary stringed instrument in accordance with this invention.
Figure 2B:
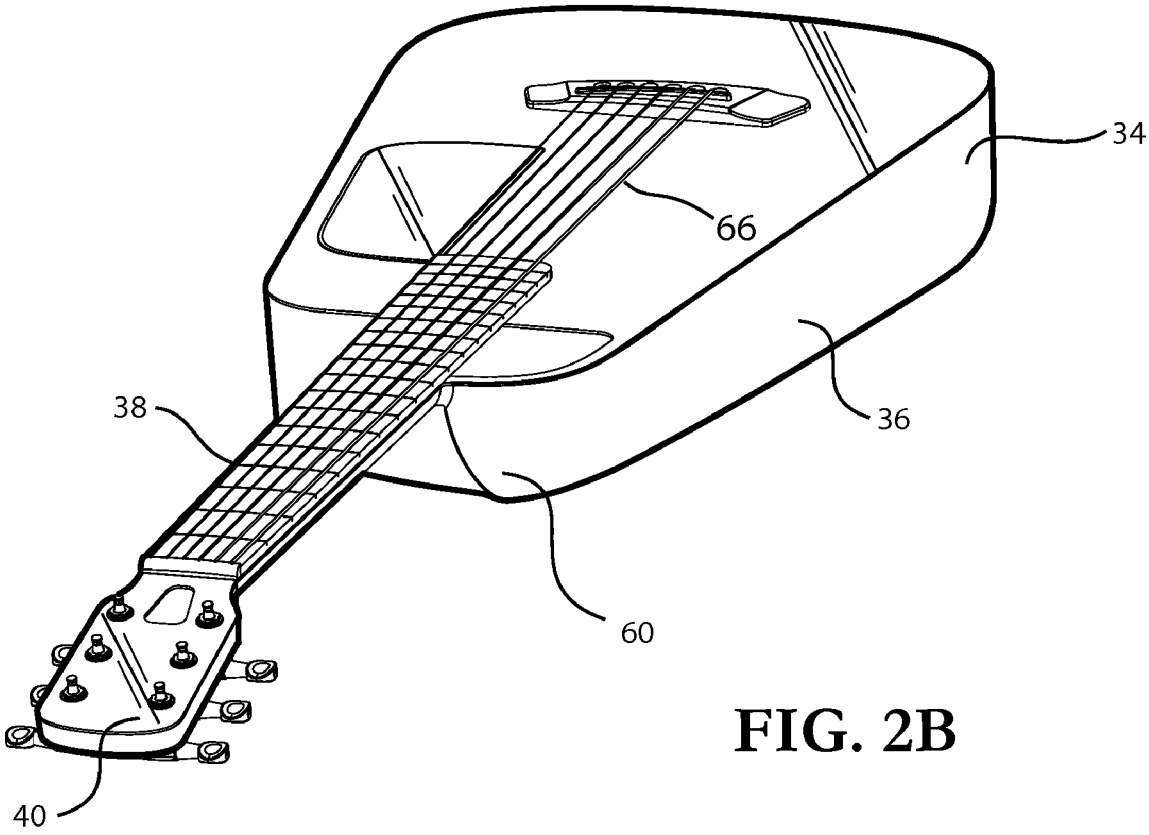
Figure 2C:
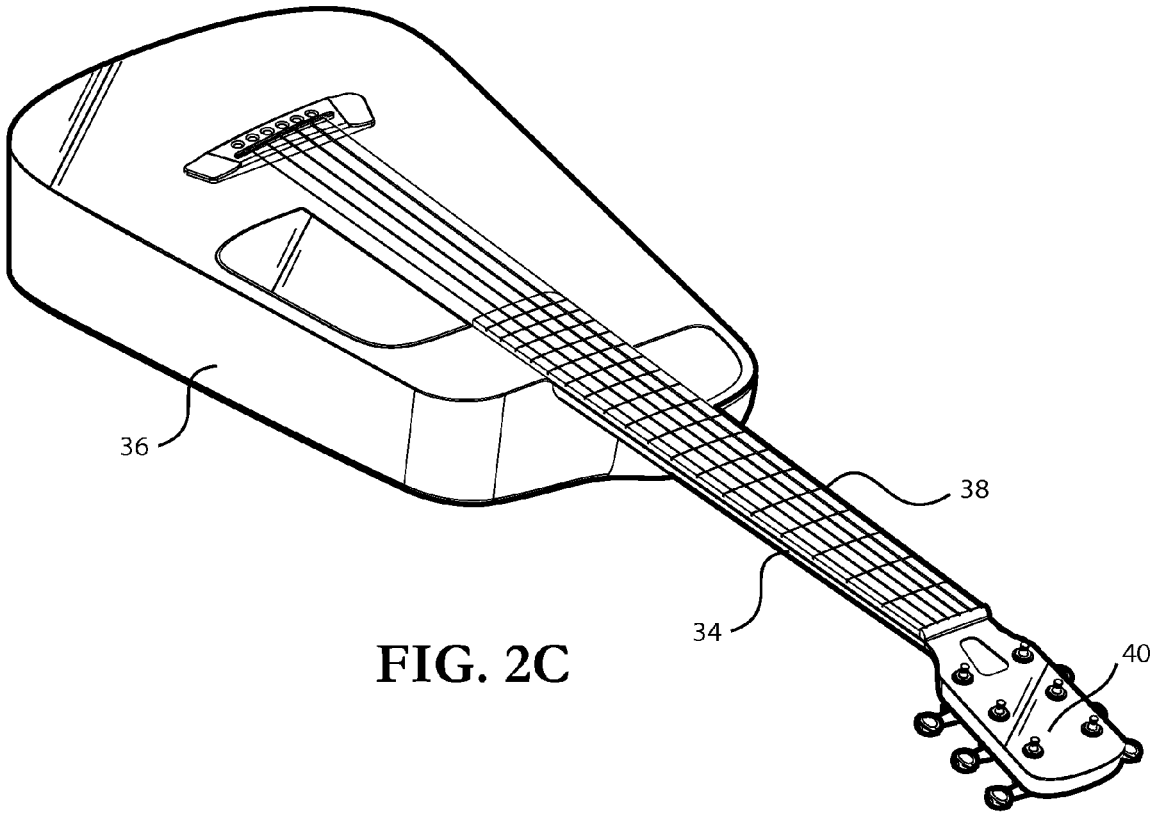
Figure 2D:
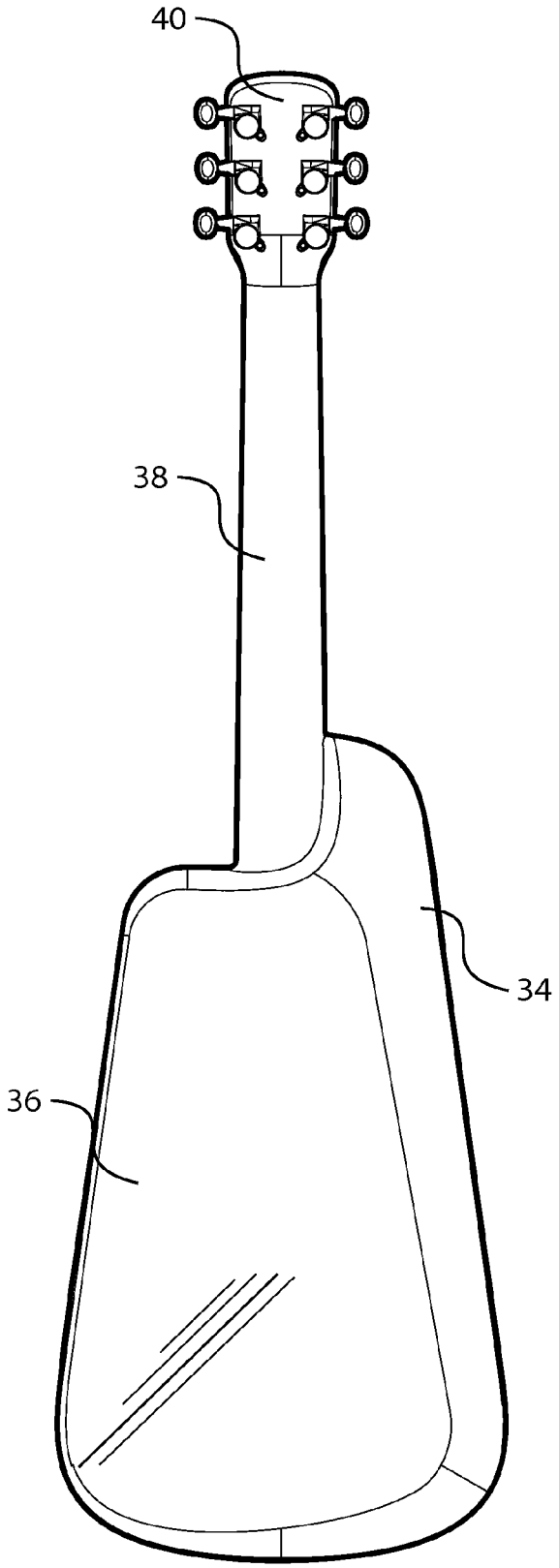
Figure 3:
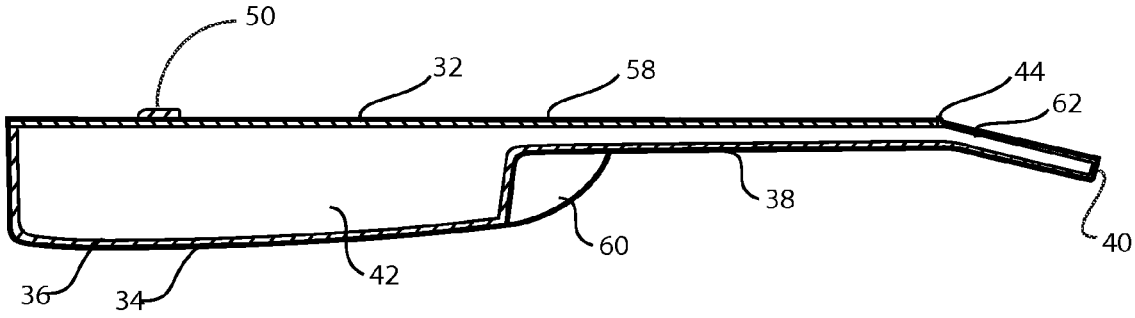
FIG. 3 is a cross-sectional view of the exemplary stringed instrument of FIG. 2.

A first exemplary embodiment of a stringed instrument in accordance with this invention is illustrated in FIGS. 2 and 3. Exemplary stringed instrument 30 includes a soundboard 32 and a unitary shell 34 that includes a body 36, a neck 38 and a head 40. As described in more detail below, unitary shell 34 may be formed by composite manufacturing processes, plastics manufacturing processes, or other similar processes, or combinations of such processes. Unitary shell 34 includes a cavity 42 extending from body 36 through neck 38 to head 40. Soundboard 32 is fixedly attached to unitary shell 34, such as by adhesives, fasteners, welds, snap-fit (e.g., as in plastic parts) or any combination thereof. Exemplary adhesives include, glue, epoxy, or other similar adhesives. Exemplary fasteners include nails, rivets, staples, or other similar fasteners.

Soundboard 32 extends from body 36, along neck 38 to a nut 44 mounted to head 40. A fingerboard 46, which includes upraised frets 48, a bridge 50 and a pickguard 52 are mounted to soundboard 32. In addition, a head top 54 is mounted to head 40 and to soundboard 32, and tuners 56 are mounted to head 40 and head top 54. Soundboard 32 includes a first sound hole 58 disposed above a body extension 60 in body 36. Head top 54 includes a second sound hole 62. Further, body 36 includes a cutaway portion 64 to form an asymmetry on one side of stringed instrument 30. Strings 66 stretch from bridge 50 over frets 48 to nut 44, and are attached to tuners 56. As shown in FIG. 3, when soundboard 32 and unitary shell 34 are joined, cavity 42 forms an elongated resonance chamber that communicates with first sound hole 58 and second sound hole 62, and that extends from body 36 through neck 38 and head 40. Persons of ordinary skill in the art will understand that head top 54 optionally may be eliminated, whereby second sound hole 62 effectively encompasses substantially the entire area of head 40.

The exemplary stringed instrument illustrated in FIGS. 2 and 3 is generally in the form of an acoustic guitar. Persons of ordinary skill in the art will understand that principles of the present invention may be applied to other stringed instruments, such as classical guitars, twelve-string guitars, electric guitars, electric acoustic guitars, jazz guitars, violins, violas, cellos, bass, double bass, citterns, lutes, mandolins, mandolas, mandocellos, ukuleles, banjos, and other similar stringed instrument.

Figure 4:
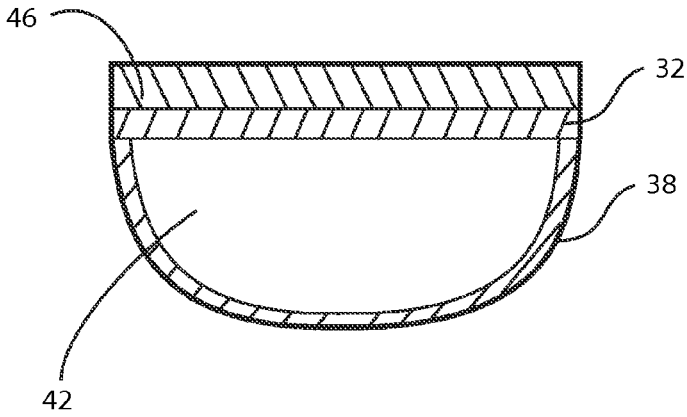
FIG. 4 is a cross-sectional view of a neck portion of the exemplary stringed instrument of FIG. 3.

The portion of cavity 42 in neck 38 may have various cross-sectional configurations. For example, FIG. 4 illustrates a cross-section of an exemplary neck 38 that includes a single semi-circular cavity area 42. Persons of ordinary skill in the art will understand that the portion of cavity 42 in neck 38 may have other cross-sectional shapes, such as circular, elliptical, crescent-shaped, or other similar shape, and may include more than one cavity.

Figure 5A:
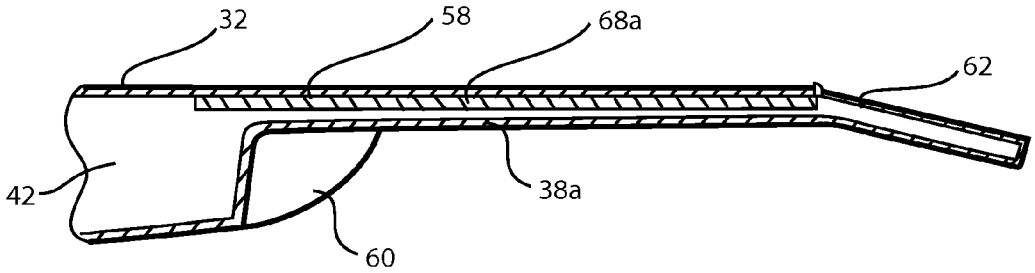
FIGS. 5A-5C are cross-sectional views of alternative exemplary stringed instruments in accordance with this invention.
Figure 6A:
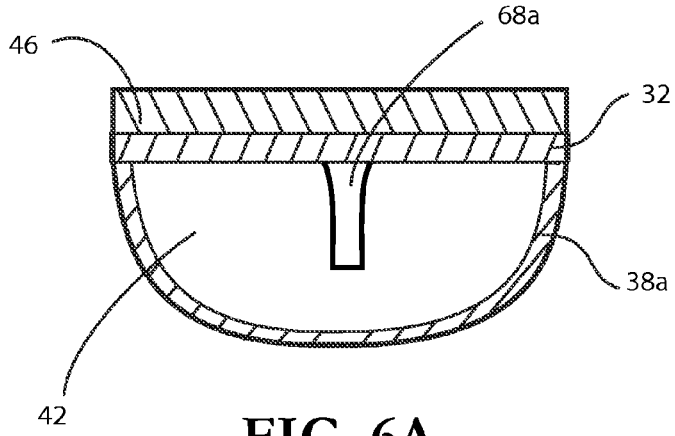
FIGS. 6A-6C are cross-sectional views of neck portions of alternative exemplary stringed instruments in accordance with this invention.

For example, FIGS. 5A and 6A illustrate an alternative exemplary neck 38*a* that includes a vertical bracing element 68*a* that extends substantially the entire length of neck 38*a* in hollow cavity 42. Bracing element 68*a* may be used to provide additional structural support to neck 38*a* to prevent neck 38*a* from bending in response to tension on strings 66, but without substantially obscuring the portion of cavity 42 in neck 38, or preventing that portion from communicating with first sound hole 58 and second sound hole 62. Bracing element 68*a* may be made of aluminum, carbon-fiber rods, or other similar light-weight, stiff material. The bracing may be adjustable such as an adjustable truss rod to modify the curvature of the fingerboard. Although bracing element 68*a* is shown as a single element, persons of ordinary skill in the art will understand that bracing element 68*a* may include more than one element. In addition, the configuration of bracing element 68*a* inside hollow cavity 42 may vary depending on the type of stringed instrument.

Figure 5B:
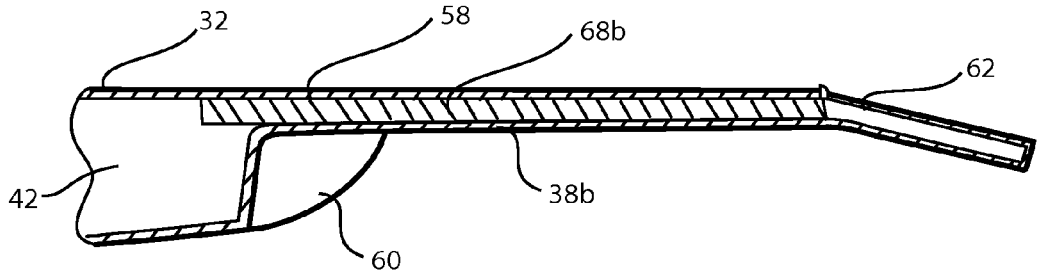
Figure 5C:
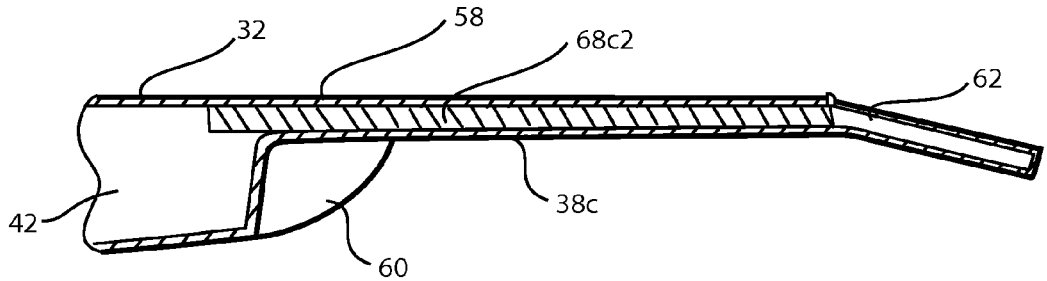
Figure 6B:
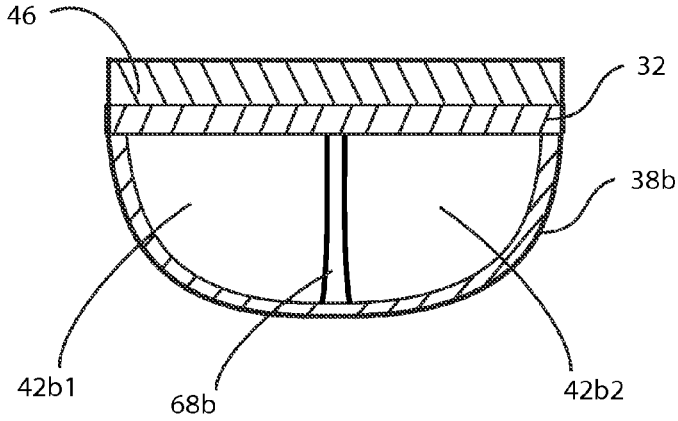
Figure 6C:
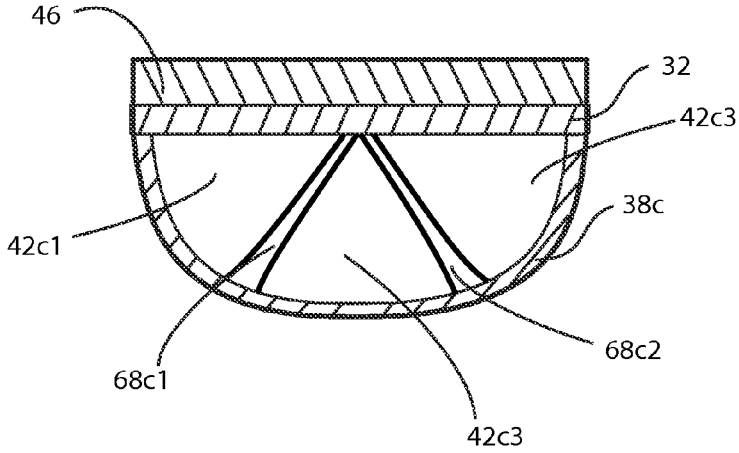

For example, FIGS. 5B and 6B illustrate an alternative exemplary neck 38*b* that includes a bracing element 68*b* that extends substantially the entire length of neck 38*b* in hollow cavity 42, and that bisects cavity 42 to form two sub-cavities 42*b*1 and 42*b*2, each of which communicates with first sound hole 58 and second sound hole 62. Likewise, as shown in FIGS. 5C and 6C, alternative exemplary neck 38*c* includes a pair of bracing elements 68*c*1 and 68*c*2 that extend substantially the entire length of neck 38*c* in hollow cavity 42, and subdivide cavity 42 into three sub-cavities 42*c*1, 42*c*2, and 42*c*3, each of which communicates with first sound hole 58 and second sound hole 62.

Figure 7A:
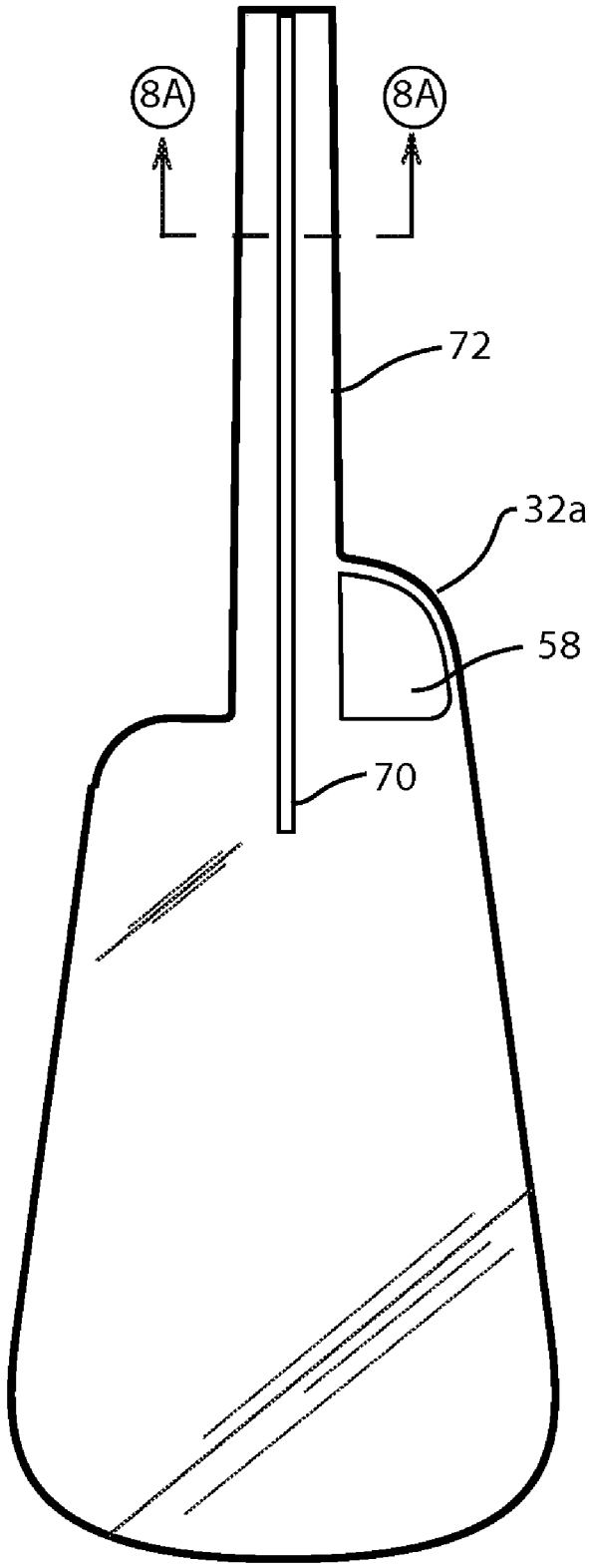
FIGS. 7A-7D are bottom plan views of exemplary soundboards in accordance with this invention.
Figure 8A:
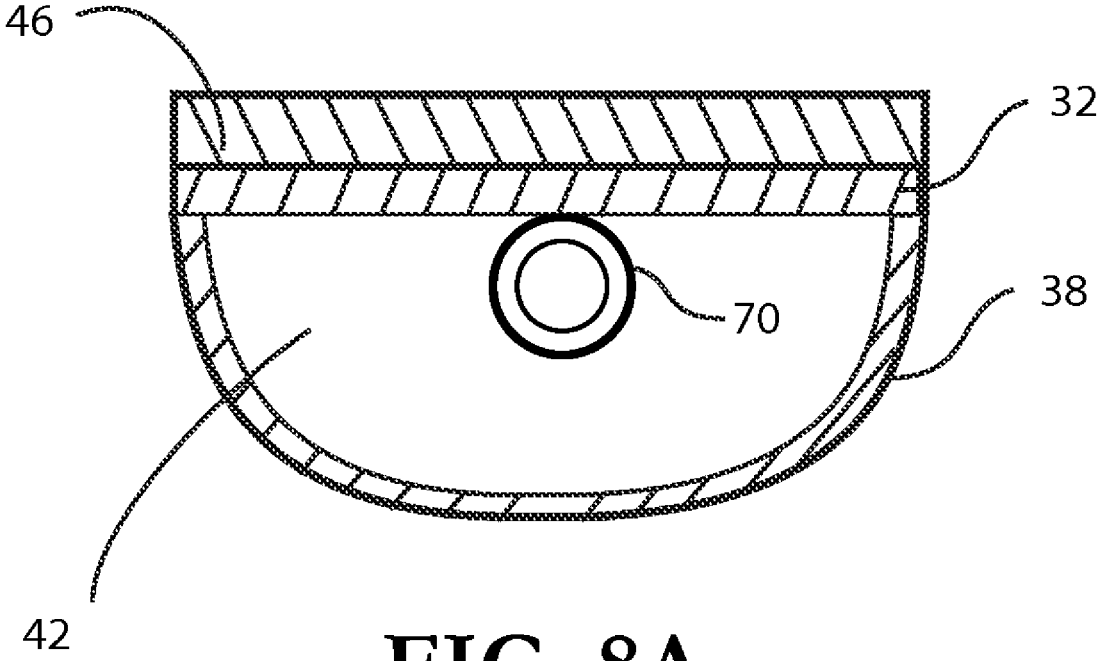
FIGS. 8A and 8B are cross-sectional views of exemplary neck portions corresponding to the views of FIGS. 7A and 7B, respectively.

Person of ordinary skill in the art will understand that other techniques may be used to provide structural support for neck 38. For example, FIG. 7A illustrates the underside of an exemplary soundboard 32*a* that includes a reinforcing tube 70 that is disposed along neck portion 72 of soundboard 32*a*. FIG. 8A illustrates a corresponding cross-sectional view of neck 38 with soundboard 32*a* attached, showing reinforcing tube 70 disposed inside hollow cavity 42. Reinforcing tube 70 preferably is made of a lightweight, strong, rigid tube, such as filament wound, unidirectional carbon tubes, or other similar tubes. Tube 70 add stiffness to neck portion 72 of soundboard 32, which in turn adds stiffness to neck 38, but without substantially obscuring the portion of cavity 42 in neck 38, or preventing that portion from communicating with first sound hole 58 and second sound hole 62. Persons of ordinary skill in the art will understand that tubes 70 may be hollow tubes or solid rods, adjustable and may be circularly or non-circularly-shaped.

Figure 7B:
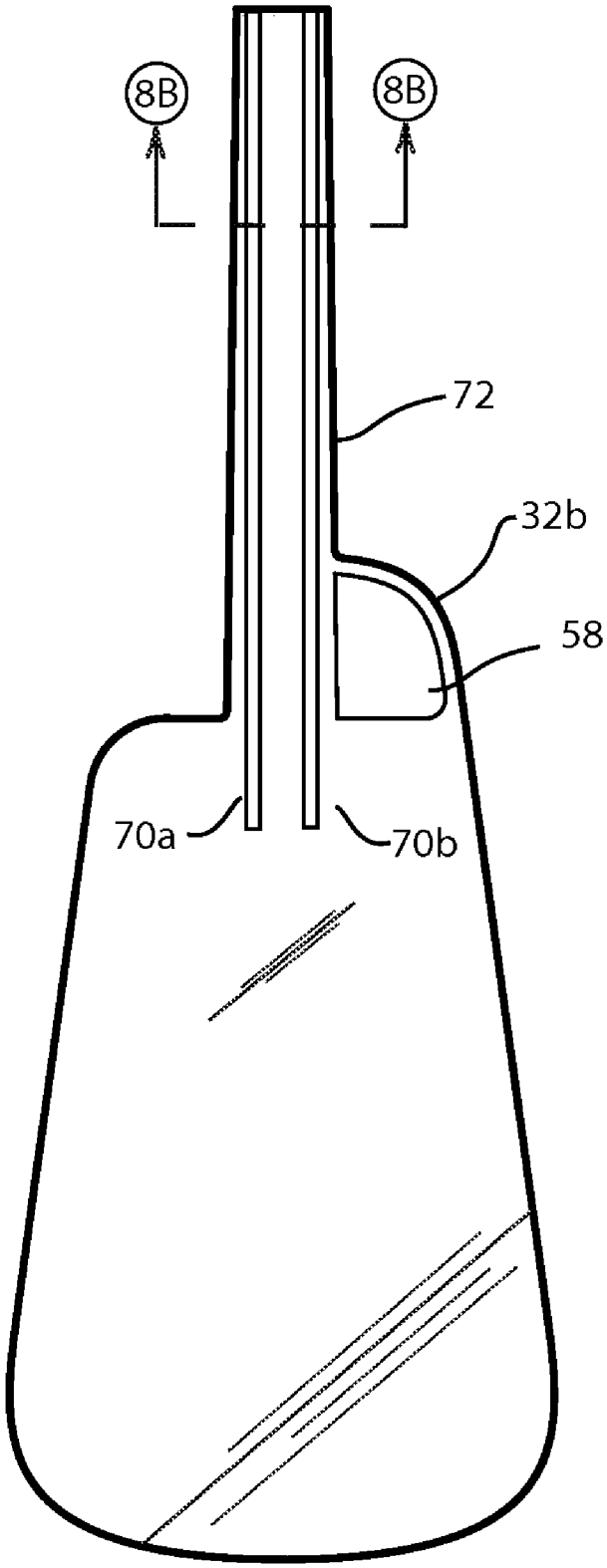
Figure 8B:
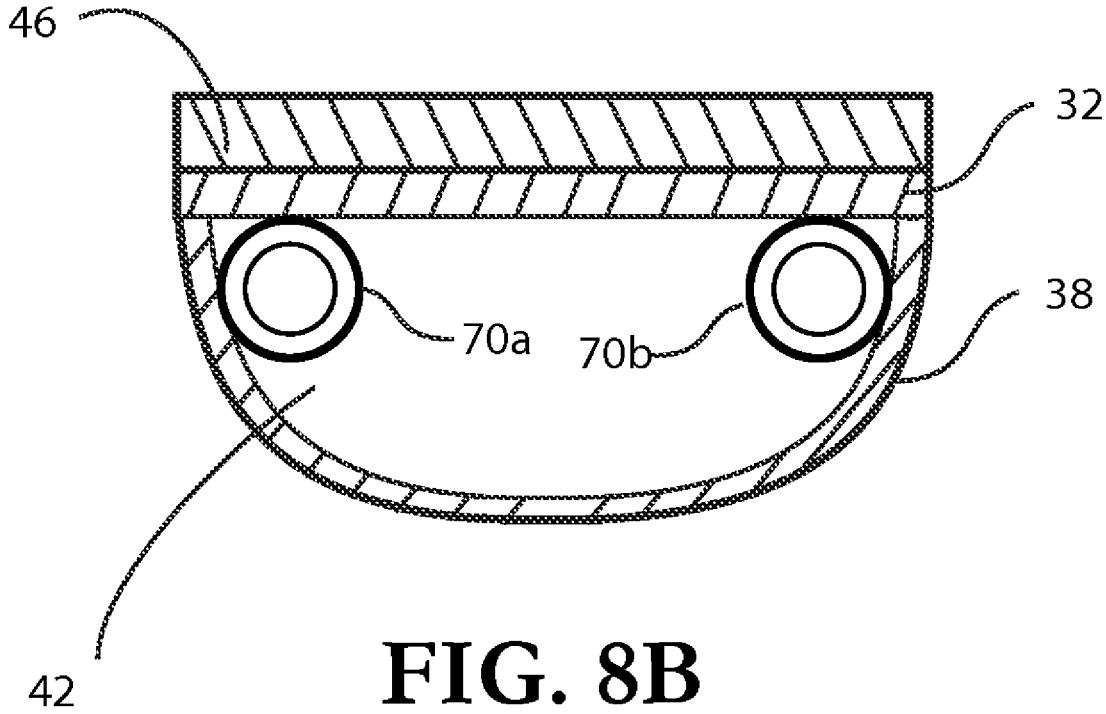

Persons of ordinary skill in the art also will understand that reinforcing tube 70 may include more than one tube. For example, FIG. 7B illustrates the underside of an alternative exemplary soundboard 32*b* that includes a pair of reinforcing tubes 70*a* and 70*b* that are disposed along neck portion 72 of soundboard 32*b*. FIG. 8B illustrates a corresponding cross-sectional view of neck 38 with soundboard 32*b* attached, showing reinforcing tubes 70*a* and 70*b* disposed inside hollow cavity 42.

Figure 7C:
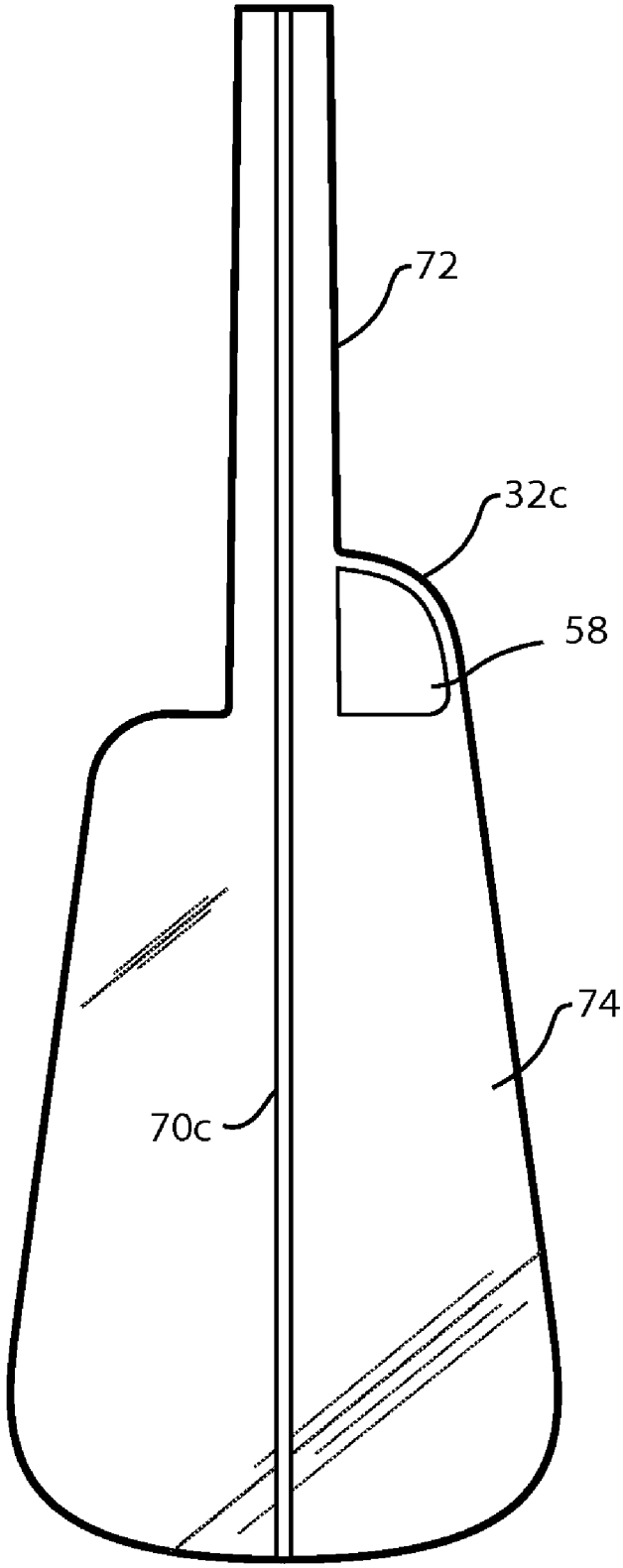
Figure 7D:
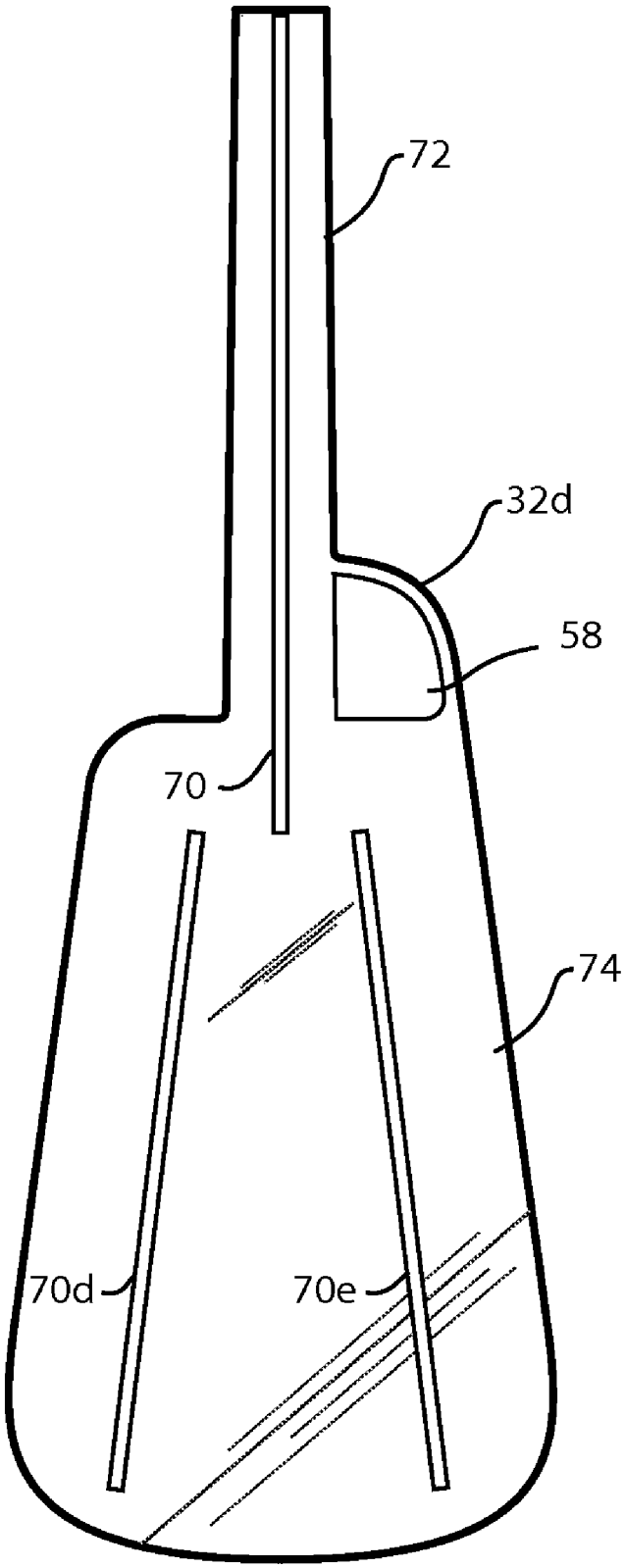

In addition to using one or more tubes 70 to stiffen neck portion 72 of soundboard 38, it also may be desirable to add stiffness to other portions of soundboard 38. For example, FIG. 7C illustrates the underside of an alternative exemplary soundboard 32*c* that includes a reinforcing tube 70*c* that is disposed along, and adds stiffness to, neck portion 72 and body portion 74 of soundboard 32*c*. Persons of ordinary skill in the art also will understand that reinforcing tube 70*c* may include more than one tube. For example, FIG. 7D illustrates the underside of another alternative exemplary soundboard 32*d* that includes a reinforcing tube 70 disposed along neck portion 72 of soundboard 32*d*, and a pair of reinforcing tubes 70*d* and 70*e* disposed along body portion 74 of soundboard 32*d*. By using such reinforcing tubes, soundboard 32*c* may be made thin and light, and yet have sufficient stiffness to reinforce neck 38 and maintain bridge 50 in its desired position.

Person of ordinary skill in the art will understand that still other techniques may be used to provide structural support for neck 38. For example, if unitary shell 34 is fabricated using composite manufacturing techniques, additional reinforcing materials, such as core material, described in more detail below, may be used in neck 38 to strengthen neck 38.

Figure 9:
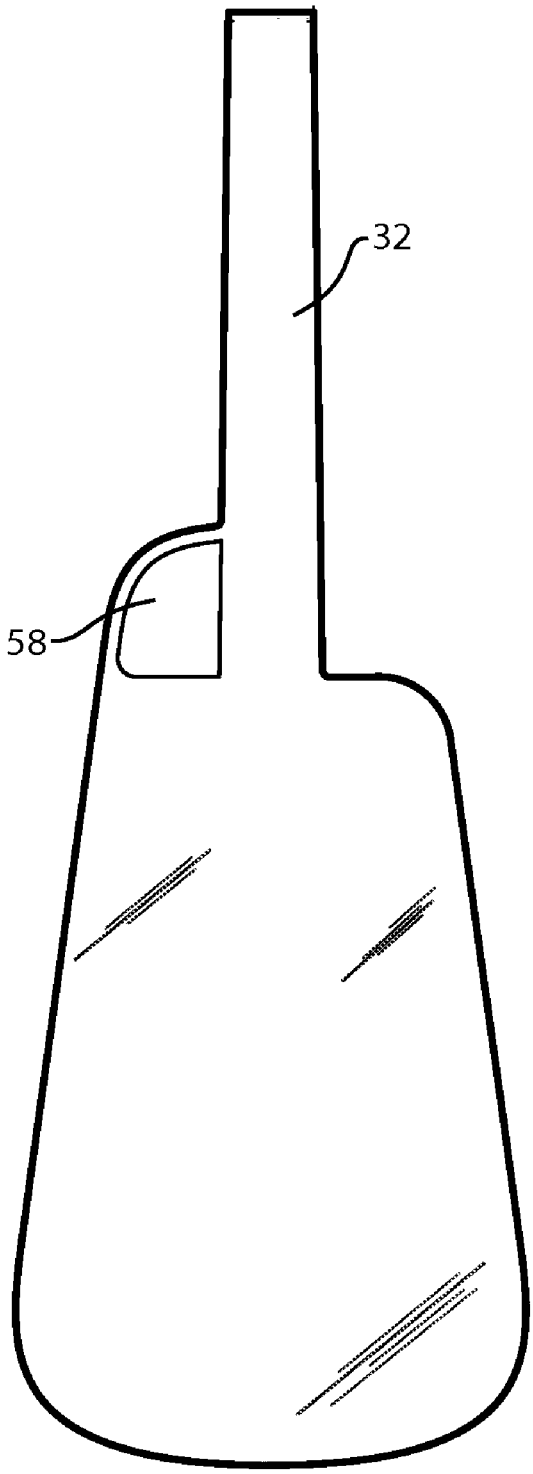
FIG. 9 is a top plan view of an exemplary soundboard in accordance with this invention.
Figure 10:
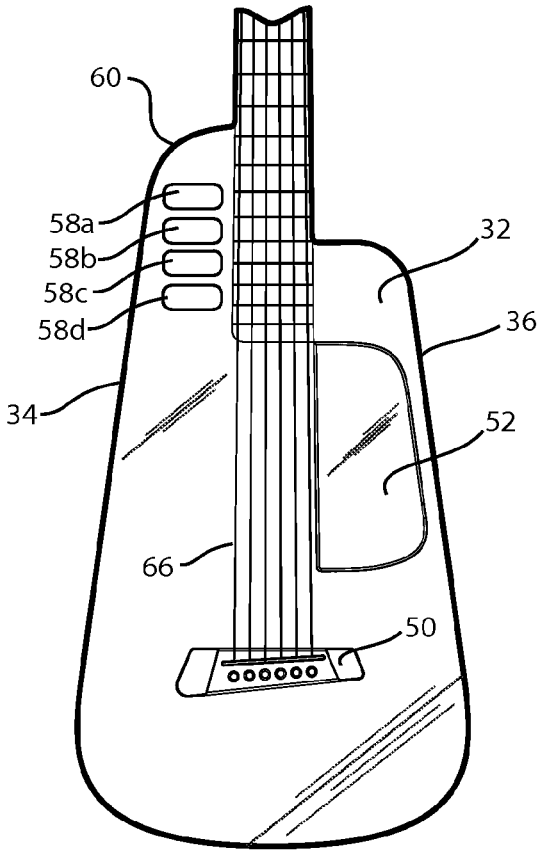
FIG. 10 is a partial top plan view of an alternative exemplary soundboard in accordance with this invention.

Referring now to FIGS. 2 and 9, soundboard 32 extends from nut 44 at head 40, along neck 38 to body 36, and includes first sound hole 58 that communicates with cavity 42. Persons of ordinary skill in the art will understand that first sound hole 58 may include more than one sound hole. For example, as shown in FIG. 10, first sound hole 58 may include a plurality of first sound holes 58*a*-58*d* that communicate with cavity 42. Although first sound holes 58*a*-58*d* are substantially equally-sized, persons of ordinary skill in the art will understand that first sound holes 58*a*-58*d* may have different sizes. Additionally, although first sound holes 58*a*-58*d* preferably have an elongated shape, persons of ordinary skill in the art will understand that first sound holes 58*a*-58*d* may have shapes other than elongate, and that the shapes of first sound holes 58*a*-58*d* may be the same or be different.

Figure 11A:
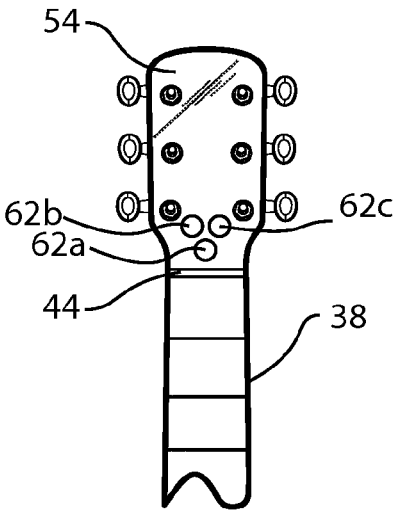
FIGS. 11A and 11B are partial top plan views of alternative exemplary heads in accordance with this invention.
Figure 11B:
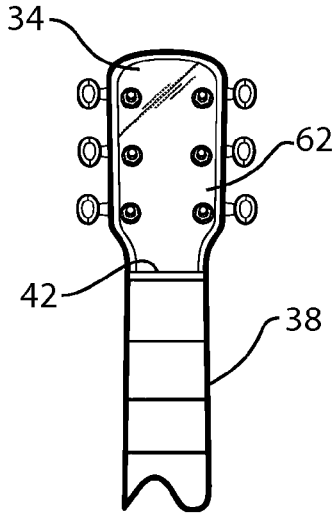

Referring to FIGS. 2 and 11, head top 54 includes second sound hole 62 that communicates with cavity 42. Persons of ordinary skill in the art will understand that second sound hole 62 may include more than one sound hole. For example, as shown in FIG. 11A, second sound hole 62 may include a plurality of sound holes 62*a*-62*b* that communicate with cavity 42. Although second sound holes 62*a*-62*c* are substantially equally-sized, persons of ordinary skill in the art will understand that second sound holes 62*a*-62*c* may have different sizes. Additionally, although second sound holes 62*a*-62*c* preferably have a circular shape, persons of ordinary skill in the art will understand that second sound holes 62*a*-62*c* may have shapes other than circular, and that the shapes of second sound holes 62*a*-62*c* may be the same or may be different. As shown in FIG. 11B, head top 54 optionally may be eliminated from head 40, whereby the opening of cavity 42 at head 40 effectively forms second sound hole 62.

Figure 12A:
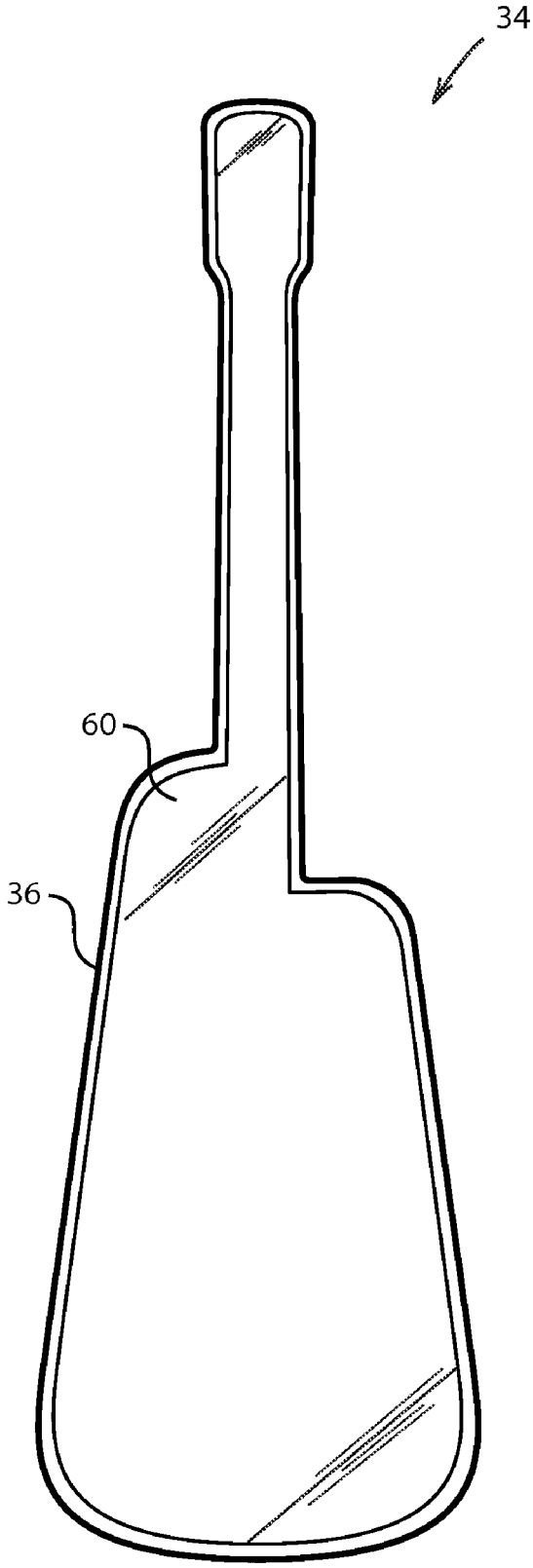
FIGS. 12A-12C are top plan views of alternative exemplary unitary shells in accordance with this invention.
Figure 12B:
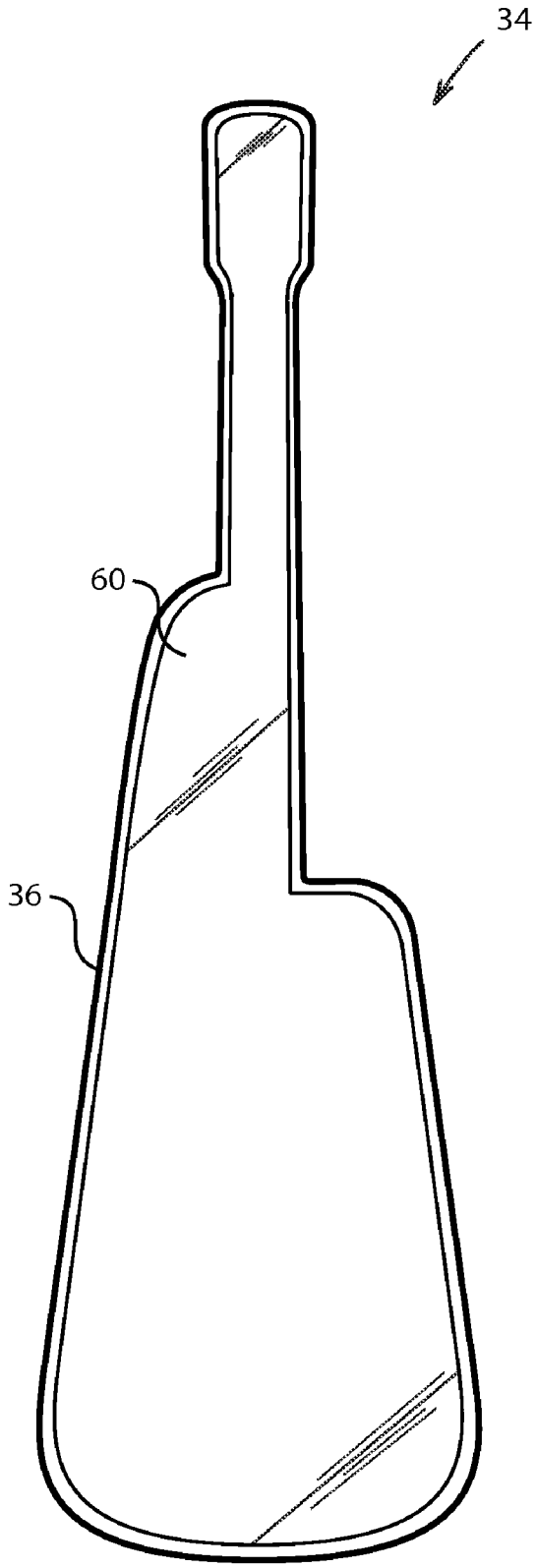
Figure 12C:
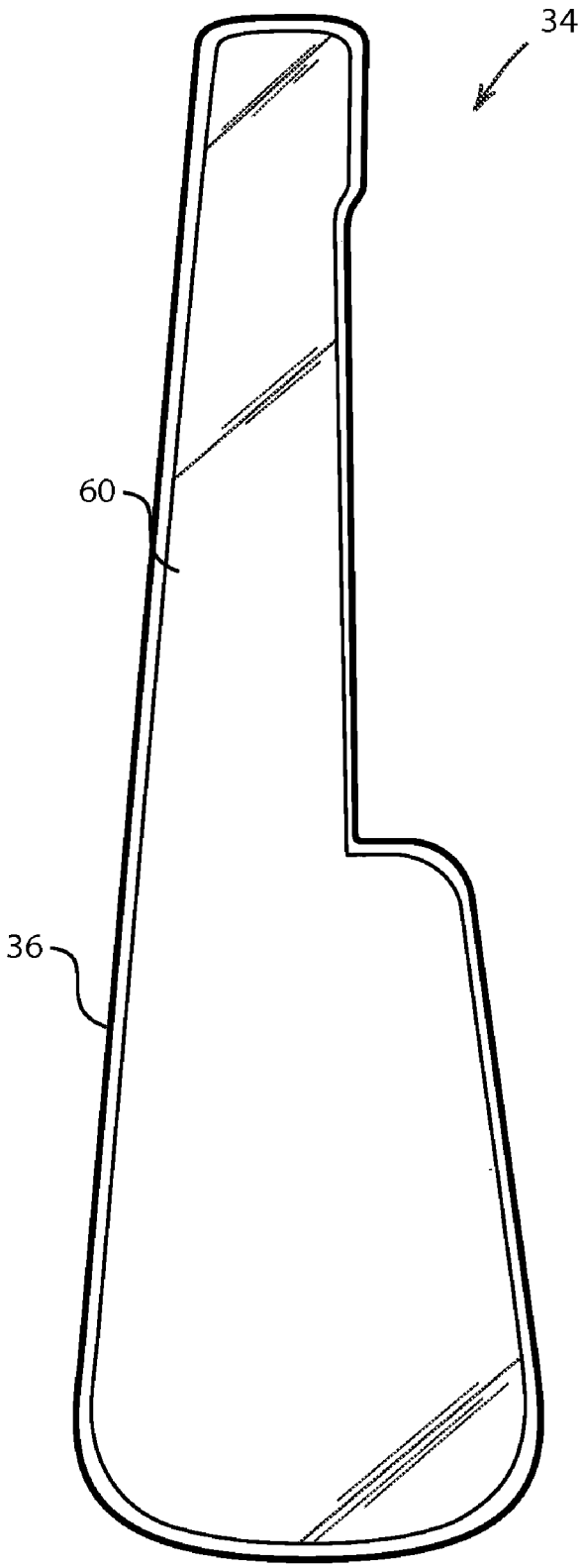
Figure 13A:
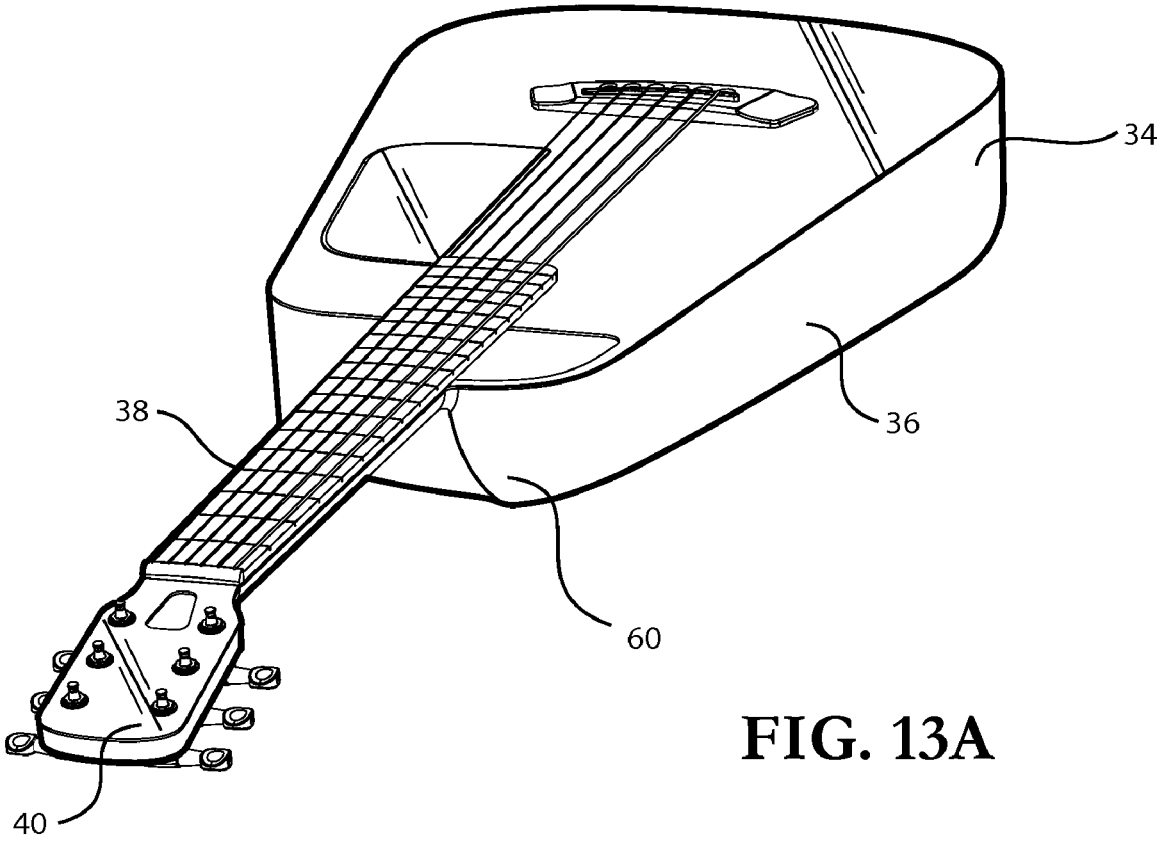
FIGS. 13A-13C are perspective side views of alternative exemplary stringed instruments in accordance with this invention.
Figure 13B:
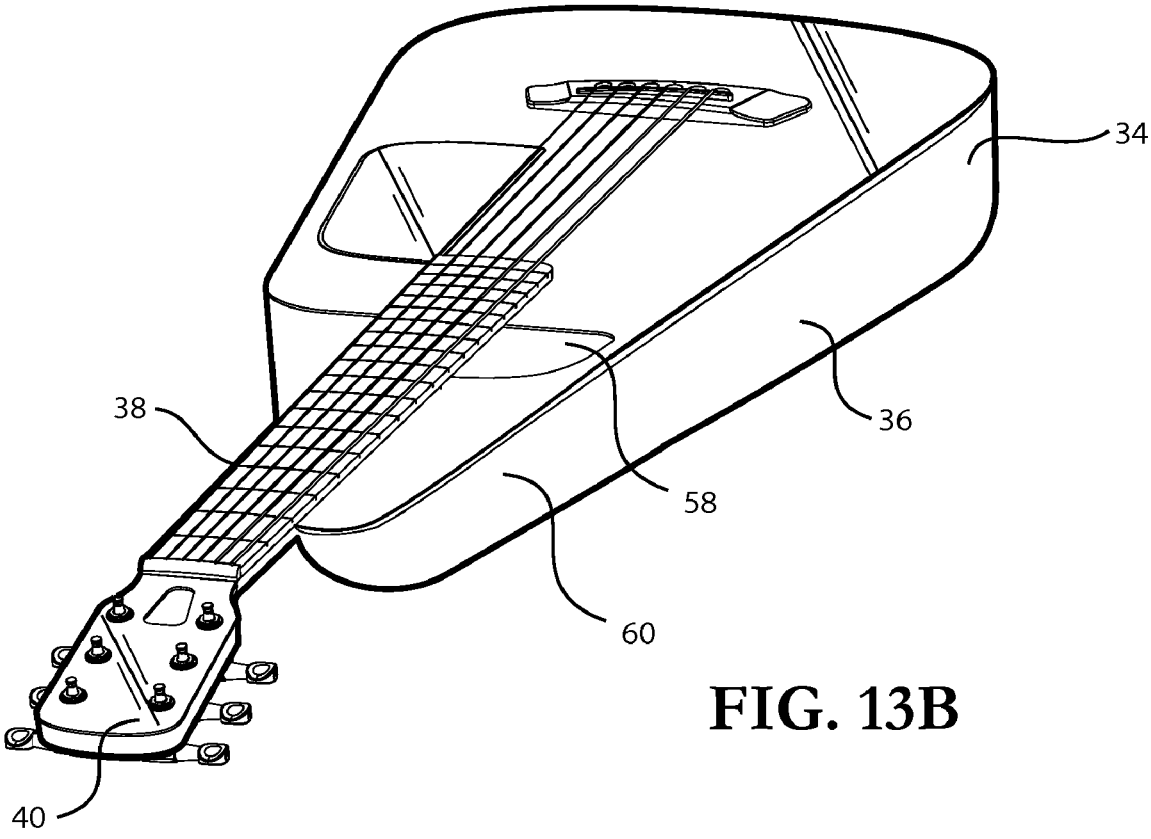

Referring now to FIGS. 12 and 13, and as described above, unitary shell 34 includes body 36, neck 38 and head 40, and cavity 42 extends from head 40 through neck 38 to body 36. Unitary shell 34 has an edge 80 that is mated with a bottom surface of soundboard 32 (not shown) to assist in creating a strong bond when soundboard 32 is fixedly attached to unitary shell 34.

Figure 13C:
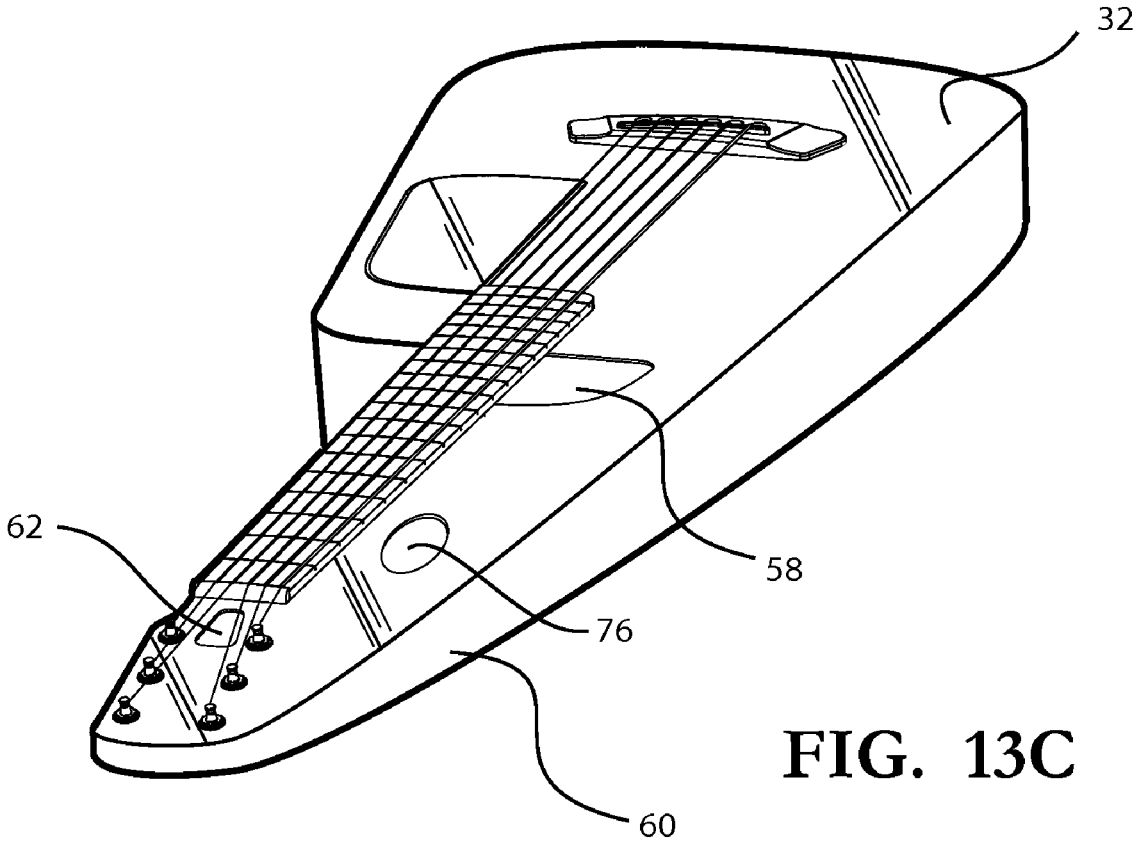

Several features of unitary shell 34 are designed to increase the resonance of stringed instrument 30. First, by providing a cavity 42 that extends from head 40 through neck 38 to body 36, cavity 42 effectively forms a large resonance chamber. In addition, as shown in FIG. 12A, body extension 60 extends toward head 40 and effectively enlarges the area of body 36 beyond the traditional body/neck joint in a conventional stringed instrument without substantially increasing the overall dimensions of the stringed instrument. In addition, body extension 60 provides a convenient area for locating first sound hole 58 away from the traditional central location used in conventional stringed instruments, which tends to decrease the resonance of such instruments. As shown in FIGS. 12B and 12C, body extension 60 may be extend to or past head 40 to further enlarge the resonance chamber. Additionally, as shown in FIG. 13C, a third sound hole 76 may be placed on the body extension 60 in various locations to project the resonance produced therein.

Figure 14A:
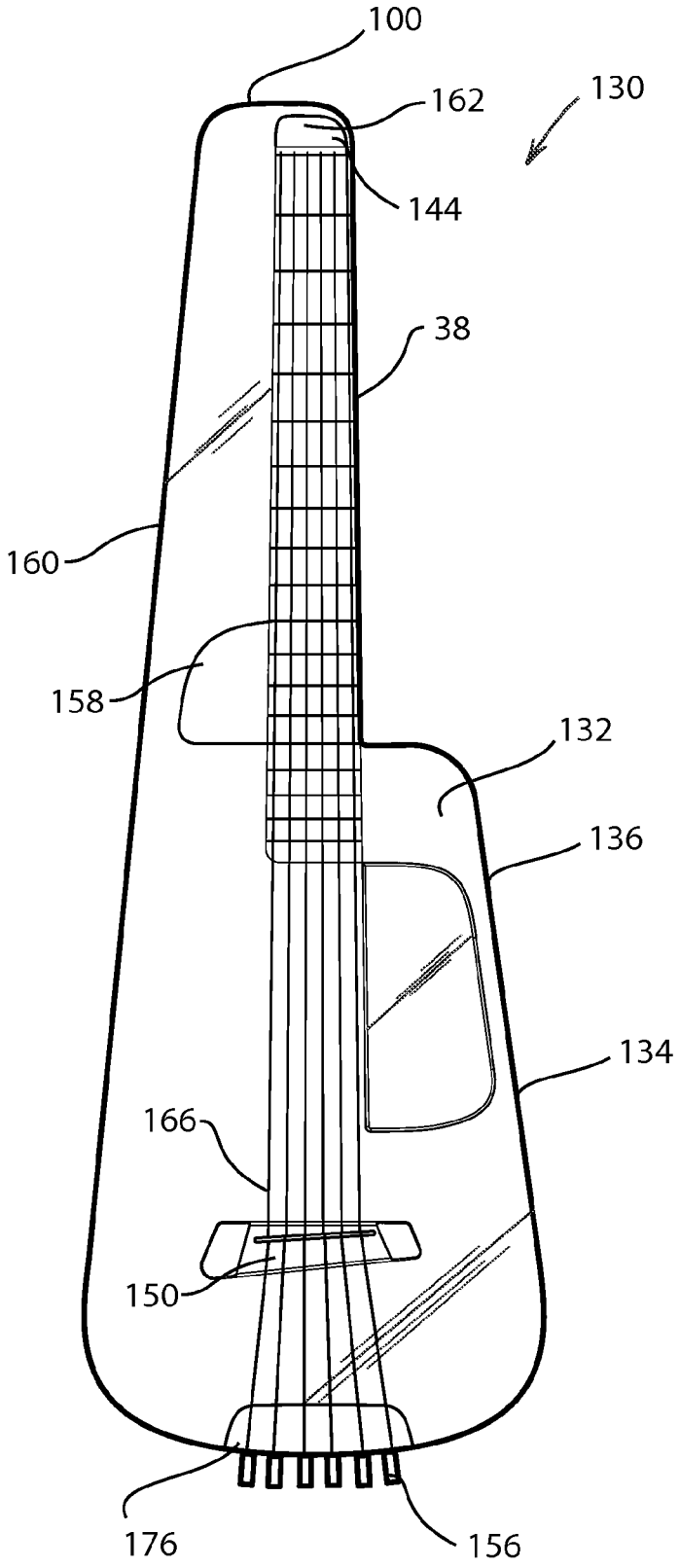
FIGS. 14A and 14B are top plan view and perspective side views of an alternative exemplary stringed instrument in accordance with this invention.
Figure 14B:
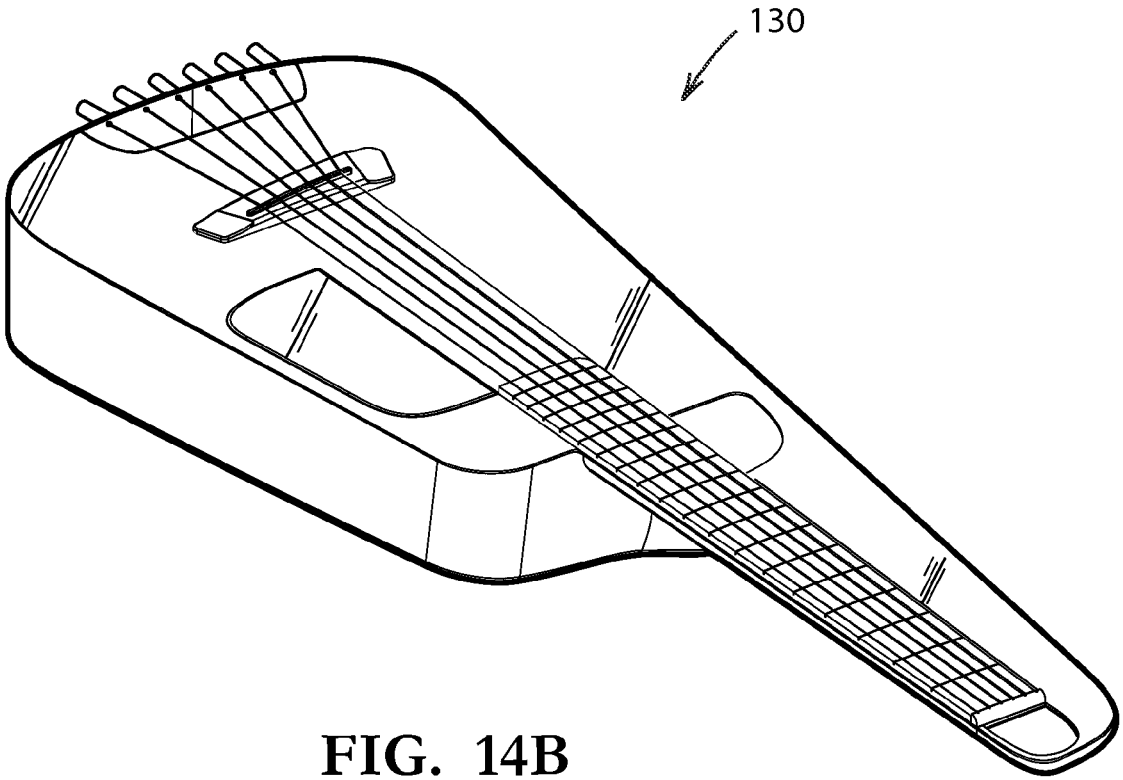

Referring now to FIG. 14, an alternative exemplary stringed instrument in accordance with this invention is described. In particular, stringed instrument 130 is a "headless" instrument that includes a soundboard 132 and a unitary shell 134 that includes a body 136 and a neck 138. Unitary shell 134 includes a cavity 142 extending from body 136 to neck 138, and soundboard 132 extends from body 136 to a top portion 100 of neck 138. Soundboard 132 includes a first sound hole 158 near body extension 160, a second sound hole 162 near top portion 100, and a third sound hole 176 near a bottom of body 136. Strings 166 stretch from bridge 150 to nut 144, and are attached to tuners 156. When soundboard 132 and unitary shell 134 are joined, cavity 142 forms an elongated resonance chamber that communicates with first sound hole 158, second sound hole 162 and third sound hole 176, and that extends from body 136 through neck 38 to top portion 100.

Figure 15:
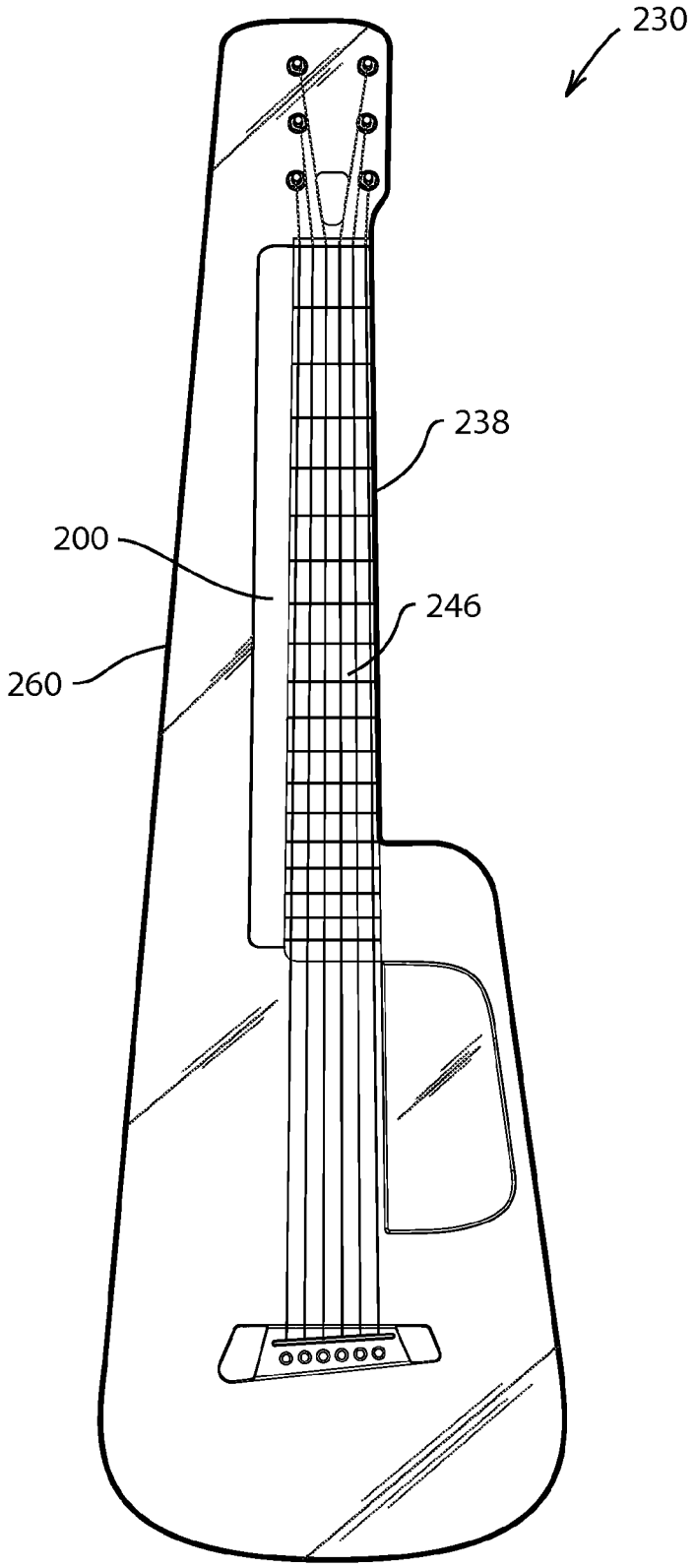
FIG. 15 is a top plan view of another alternative exemplary stringed instrument in accordance with this invention with a center void.

Referring now to FIG. 15, another alternative exemplary stringed instrument in accordance with this invention is described. In particular, stringed instrument 230 includes a body extension 260 separated from neck 238 by a center void section 200 that allows a user to have better fingertip access to fingerboard 246.

As described above, unitary shell 34 may be formed by composite manufacturing processes, such as vacuum bagging and vacuum infusion. In such processes, unitary shell 34 is formed with a single female mold, which allows for relatively low tooling costs verses multiple mold methods. The mold can be made of any material that will survive the curing conditions. Molds preferably are made of aluminum, composites, stainless steel, or other similar materials. The mold is typically coated with a mold-release agent, as known in the art, and is then covered with one or more layers of a fiber cloth, resin, optionally a core material, described in more detail below, and one or more additional layers of fiber cloth. The fiber cloth may include carbon, aramid, boron, silicon carbide, or tungsten fiber cloth or other similar fiber cloths, and the resin may include epoxy, polyester, biocomposite, vinylester, or phenolic resins, or other similar resins.

Vacuum bagging is an exemplary low cost manufacturing process for creating unitary shell 34. Vacuum bagging creates mechanical pressure on the fiber fabric during the resin cure cycle. Pressurizing a composite lamination removes trapped air between layers, compacts the fiber layers for efficient force transmission among fiber bundles and prevents shifting of fiber orientation during cure, reduces humidity, and optimizes the fiber-to-resin ratio in the composite part.

Vacuum infusion is an alternative exemplary manufacturing process for creating unitary shell 34. In particular, vacuum infusion is generally a preferred method of manufacture with resin infused parts for obtaining higher strength-to-weight ratios than traditional vacuum bagging. Vacuum infusion also has a relatively low cost of tooling with more highly controlled fabric and layout and resin content. Like vacuum bagging, vacuum infusion uses vacuum pressure to drive resin into the layers of fabric laid into the female mold. Unlike vacuum bagging the reinforcement cloth is carefully arranged and laid dry into the mold and the vacuum is applied before resin is introduced. Once a complete vacuum is achieved, resin is sucked into the laminate via carefully placed tubing.

Unitary shell 34 alternatively may be manufactured using male and female mold pieces that have a receptacle area that is shaped to form shell 34. The molds have similar requirements to those used in vacuum bagging and vacuum infusion. The mold pieces are then mated, clamped tightly, and the resin is cured to fully harden the polymeric material.

In preferred embodiments, the number of layers of fiber cloth is selected to produce a thickness of the cured composite material that is preferably in the range of about 1 to 7 mm. The number of layers of fiber cloth used will depend on the properties of the cloth, and typically ranges from 2 to 9 cloth layers. When two or more pieces of the same type fiber cloth are laid adjacent, they form essentially one layer of that type of material in the final cured composite.

The fiber cloth pieces may be already impregnated with resin ("prepreg"). Otherwise, or if more resin is needed, additional resin may be added to saturate or fully impregnate the cloth layers after they are laid in the mold pieces. As is well known to practitioners, sufficient resin must be added so that the cured composite does not have voids of a number that degrade its mechanical properties. For example, the fiber-resin composite may be cured by resin transfer molding, structural reaction injection molding, resin film infusion, autoclave molding, compression molding, or other similar molding processes.

Fiber cloth pieces impregnated in a thermoplastic, such as unidirectional carbon fiber and polypropylene, may also be used to form shell 34. Thermoplastic "prepreg" is more inexpensive then resin prepreg, allows for more consistent parts and faster production cycles by eliminating curing. Compression molding, hydroforming, matched die forming and thermoforming are all suitable molding processes.

For added strength, unidirectional and bidirectional fiber cloths may be used. Unidirectional fiber cloth has maximal stiffness and strength in one direction, and allows for the highest concentration of cloth reinforcement strands in one direction. Unidirectional fiber cloth is particularly useful in the relatively thin neck 38, which requires significant stiffness to counter the tension of the strings. To achieve the desired stiffness, 1-6 layers of unidirectional fiber cloth are laid in the neck section of the mold, with the strands oriented parallel to the strings. Unidirectional fiber may also be oriented at a 90 or 45 degree angle to the strings to enhance twisting stiffness. Bidirectional fiber cloth exhibits strength and stiffness in two directions, and is thus used in one or multiple layers on the exterior and interior of the instrument to provide resiliency.

As is well known to practitioners, the fiber cloth and resin matrix may be significantly thickened and therefore strengthened with the use of a core material. To be effective, the core material is placed between two or more layers of fiber cloth. This methodology is utilized both in body 36, neck 38 and head 40. The core may be un-patterned, or may be patterned, such as a honeycomb. Due to cost, a preferred material is a 2 mm thick fabric with a honeycomb pattern, such as Lantor Soric, manufactured Lantor BV, Veenendaal, The Netherlands. Other core materials made from foam, wood, metal and plastics with or without a pattern may also be used. To reduce weight, some core material may be removed from areas that do not require increased stiffness, such as the back of the body 36.

Alternatively, unitary shell 34 may be fabricated by applying a fiber-reinforced mixture such as glass and epoxy onto a undersized polyurethane foam core (referred to herein as a "preform"). The preform is then placed into a matched cavity mold, and heat and pressure are applied to cure the resin. Other materials suitable for this process include biodegradable materials, such as Zelfo, manufactured by Zelfo Australia, Mullumbimby, Australia. Zelfo is a fiber-reinforced mixture made solely out of plant fibers, that can be created in a number of configurations including hemp and sugar.

As an alternative to composite manufacturing processes, unitary shell 34 may be formed from a plastics material (e.g., polycarbonate, fiber reinforced nylon, acrylonitrile butadiene styrene, phenolic or other similar plastics material) without a fiber cloth. For example, unitary shell 34 may be fabricated by injection molding, compression molding, vacuum-forming or other similar techniques.

As described above, soundboard 32 ideally is thin and light, yet sufficiently stiff for efficiently communicating sound from strings 66 to cavity 42. Preferably, soundboard 32 is between 0.5 mm to 4 mm thick. Soundboard 32 may be manufactured from a fabric resin matrix, plastics, fiber-reinforced plastics, ceramics or wood. In a preferred embodiment, soundboard 32 is 1 mm thick, and is made with both unidirectional and bi-directional pre-preg carbon and glass fibers. Soundboard 32 also may be manufactured with a core material. Soundboard 32 also may be manufactured with a core material such as Nomex®, an aramid honeycomb manufactured by E. I. du Pont de Nemours and Company, Wilmington, Del., USA. Persons of ordinary skill in the art will understand that other core materials may also used. A preferred method of manufacturing is compression molding or autoclaving. Vacuum-bagging, vacuum-infusion and other techniques also may be used.

Figure 16:
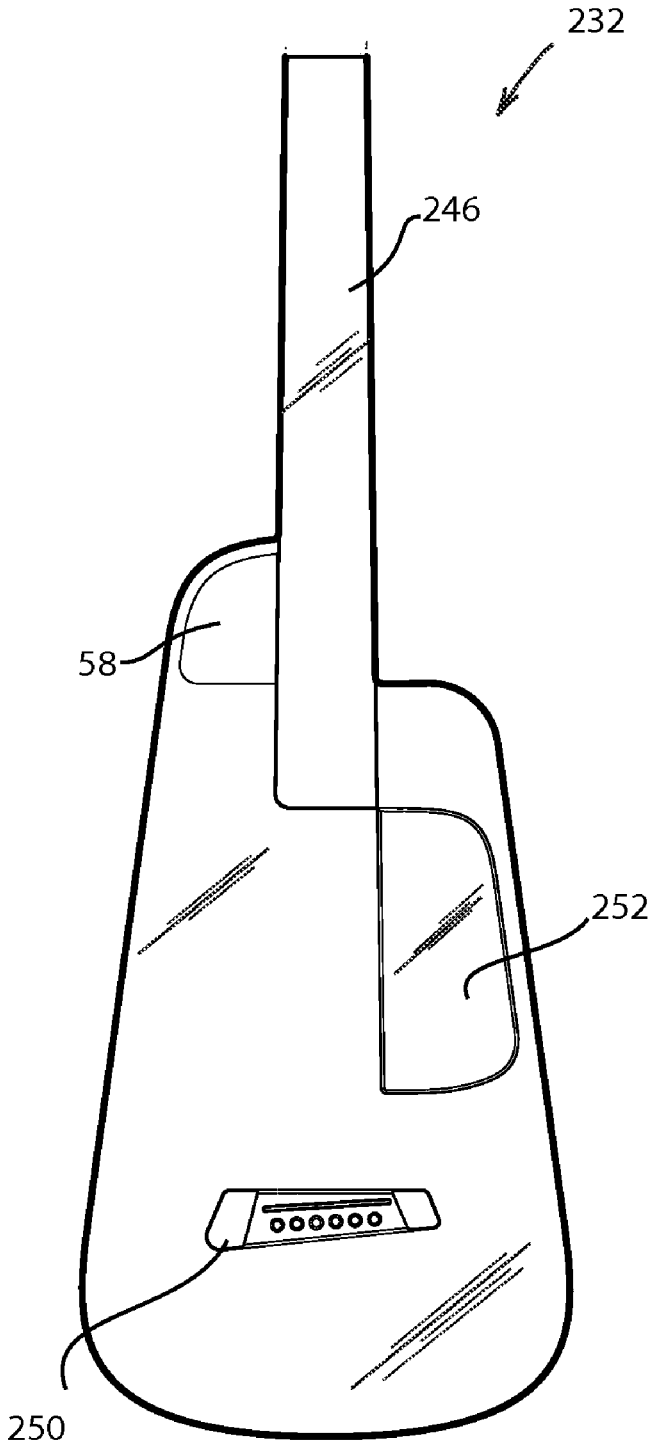
FIG. 16 is a top plan view of an alternative exemplary soundboard in accordance with this invention.

Referring now to FIG. 16, an alternate soundboard in accordance with this invention is described. In particular, soundboard 332 includes integral fingerboard 346, bridge 350 and pickguard 352, all manufactured as one unitary part. By way of example and not by way of limitation, this part may be constructed from a composite fabric and binding agent inserted a mold that is formed around a negative impression of the final part. A solid head may also be used with this embodiment to increase the structural integrity of the instrument.

FIGS. 17A-E illustrate yet another exemplary embodiment of the string instrument in accordance with the present invention. Stringed instrument 1700 share several features of exemplary instrument 30, but has an asymmetrical waist. Instrument 1700 includes a soundboard 1732 and a unitary shell 1734 that includes a body 1736, a neck 1738 and a head 1740. As described above, unitary shell 1734 may be formed by composite manufacturing processes, plastics manufacturing processes, or other similar processes, or combinations of such processes. Unitary shell 1734 includes a cavity 1742 extending from body 1736 through neck 1738 to head 1740. Soundboard 1732 is fixedly attached to unitary shell 1734 in the manner described above for instrument 1700.

Soundboard 1732 extends from body 1736, along neck 1738 to a nut 1744 mounted to head 1740. A fingerboard 1746 with upraised frets 1748, a bridge 1750 and an optional pickguard (not shown) can be mounted to soundboard 1732. In addition, a head top 1754 is mounted to head 1740 and to soundboard 1732, and tuners 1756 are mounted to head 1740 and head top 1754. Soundboard 1732 includes a sound hole 1758. Head top 1754 may include a supplemental sound hole 1762. Further, body 1736 includes a cutaway portion 1764 to form an asymmetry on one side of stringed instrument 1700. Strings 1720 stretch from bridge 1750 over frets to nut 1744, and are attached to tuners 1756. As shown in the longitudinal cross-section FIG. 17D, when soundboard 1732 and unitary shell 1734 are joined, cavity 1742 forms an elongated resonance chamber that communicates with sound hole 1758 and supplemental sound hole 1762, and that extends from body 1736 through neck 1738 and head 1740. Persons of ordinary skill in the art will understand that head top 1754 optionally may be substantially or completely eliminated, whereby supplemental sound hole 1762 effectively encompasses substantially the entire top area of head 1740.

The exemplary stringed instrument 1700 illustrated in FIGS. 17A-E is generally in the form of an acoustic guitar. Persons of ordinary skill in the art will understand that principles of the present invention may be applied to other stringed instruments, such as classical nylon-stringed guitars, twelve-string guitars, electric guitars, electric acoustic guitars, jazz guitars, violins, violas, cellos, bass, double bass, citterns, lutes, mandolins, mandolas, mandocellos, ukuleles, banjos, harps, and other similar stringed instrument.

In accordance with another aspect of the present invention, instrument 1700 includes an asymmetrical waist with a substantially flat side 1782 and a substantially concave side 1784. A (primary) sound hole 1758 is located substantially adjacent to the flat side 1782 as shown in FIG. 17.

The profile of the substantially flat side 1782 can flat, slightly concave or slightly convex. Hence, several combinations of the asymmetrical waist of instrument 1700 are possible. For example, a slightly concave side may be paired with a substantially concave side. Alternatively, a slightly concave side may be paired with a substantially concave side.

The portion of cavity 1742 in neck 1738 may have various cross-sectional configurations. For example, FIG. 17E illustrates a cross-section of an exemplary neck 1738 that includes a single semi-circular cavity area 1742. Persons of ordinary skill in the art will understand that the portion of cavity 1742 in neck 1738 may have other cross-sectional shapes, such as circular, elliptical, crescent-shaped, or other similar shape, and may include more than one cavity.

Referring back to FIGS. 5A-5C, 6A-C, 7A-7B and 8A-8B, neck 1738 can be braced in a similar manner described above for neck 38 of exemplary instrument 30. Person of ordinary skill in the art will understand that other techniques may be used to provide structural support for neck 1738.

Figure 18A:
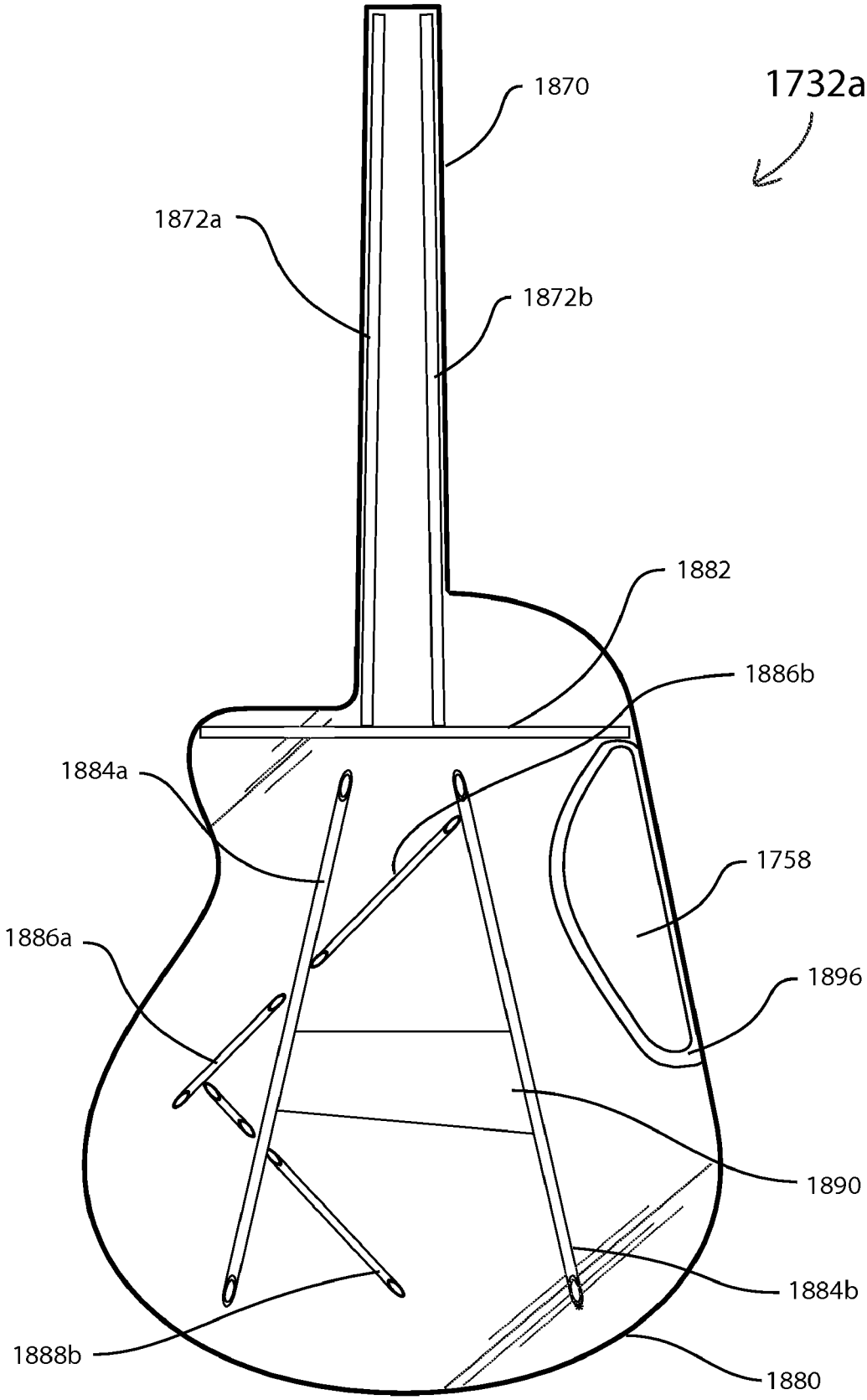
FIGS. 18A, 18B illustrate two exemplary bracing patterns for the soundboard of the stringed instrument of the present invention.
Figure 18B:
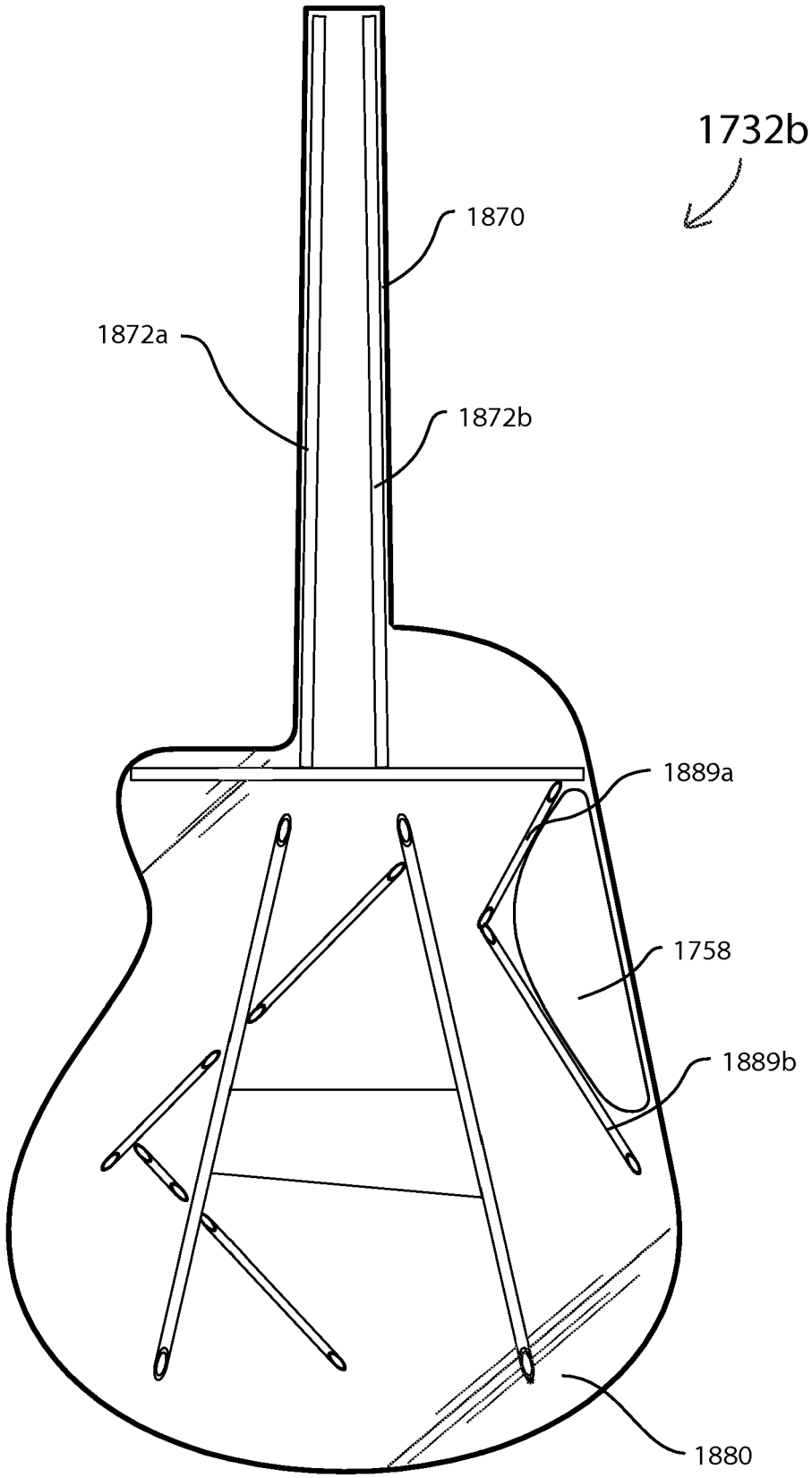

FIGS. 18A, 18B illustrate exemplary soundboard bracing patterns in accordance with the present invention. In addition to using one or more tubes to stiffen neck portion, it also may be desirable to add stiffness to other portions of asymmetrical soundboard of the stringed instrument. For example, FIG. 18A illustrates the underside of an exemplary soundboard 1732*a* that includes a couple of reinforcing tubes 1872*a*, 1872*b* that is disposed along, and adds stiffness to, neck portion 1870 of soundboard 1732*a*, and extending into body portion 1880 of soundboard 1732*a*.

Person of ordinary skill in the art will understand that still other techniques may be used to provide structural support for neck 1738. For example, if unitary shell 1734 is fabricated using composite manufacturing techniques, additional reinforcing materials, such as core material, described in more detail below, may be used in neck 1738 thereby increasing neck strength.

As shown in FIG. 18A, a cross tube 1882 is disposed adjacent to and substantially perpendicular to the tubes 1872*a*, 1872*b*. Cross tube 1882 adds cross body strength to body portion 1880. One or more diagonal tubes, e.g., tubes 1884*a*, 1884*b* are added to increase longitudinal strength of body portion 1880. Additional diagonal tubes, such as tubes 1886*a*, 1886*b* and/or tubes 1888*a*, 1888*b* may also be added thereby further increasing body portion strength and rigidity.

Suitable neck and body reinforcing tubes include carbon fiber tube with or without one or more tapered ends. It is possible to use square tubes or U-shaped tubes, or combinations thereof. In this example, reinforcing tubes are approximately 5 mm in diameter. It is also possible to use a combination of bracing tubes of differing diameters depending on the length of the tube. To reduce weight, perforated tubes can also be used. By using such reinforcing tubes, soundboard 1732*a* may be made thin and light, and yet have sufficient stiffness to reinforce neck 1738 and maintain bridge 1750 in its desired position.

Figure 17A:
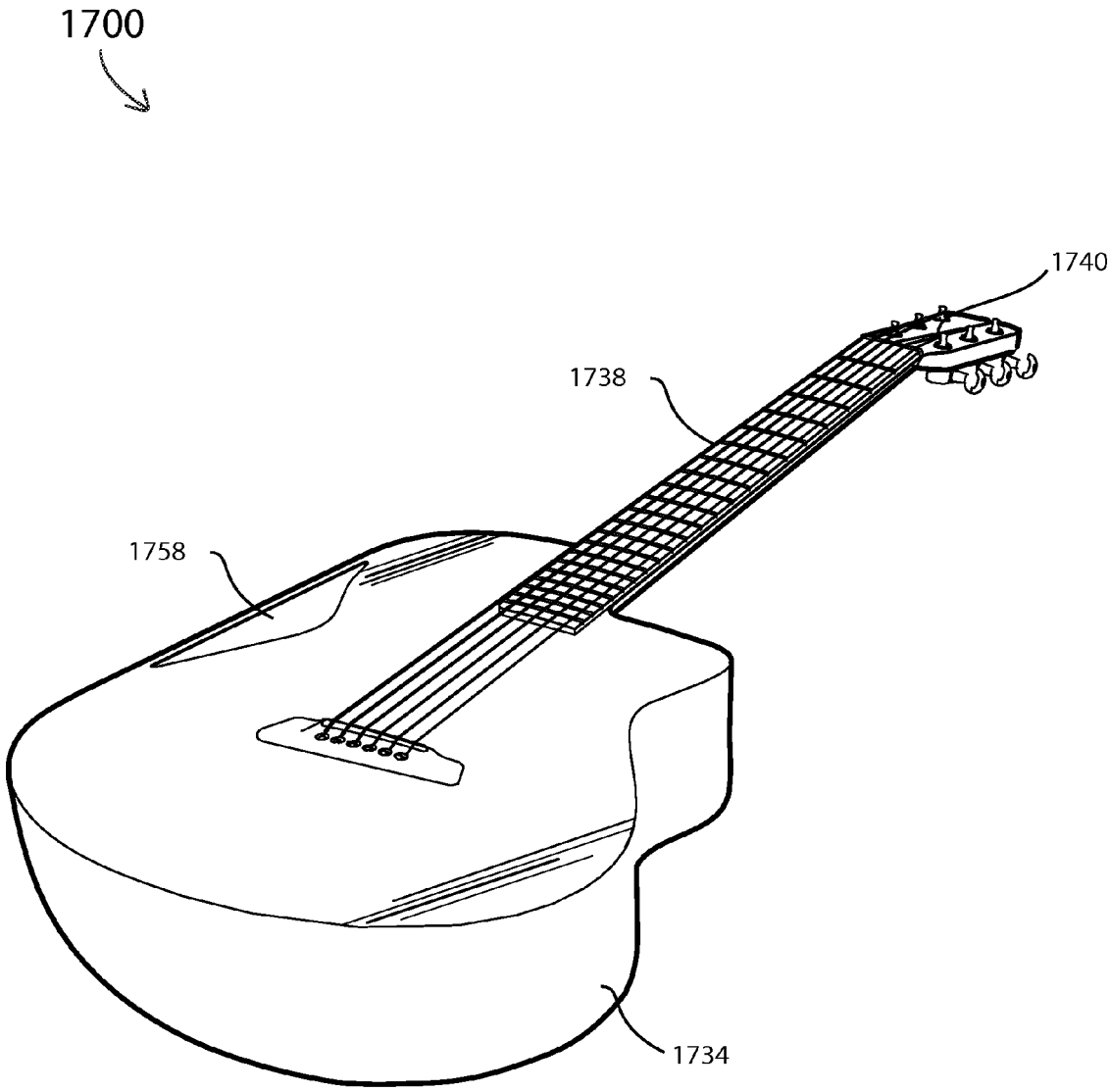
FIGS. 17A-17E illustrate yet another exemplary stringed instrument in accordance with this invention.
Figure 17B:
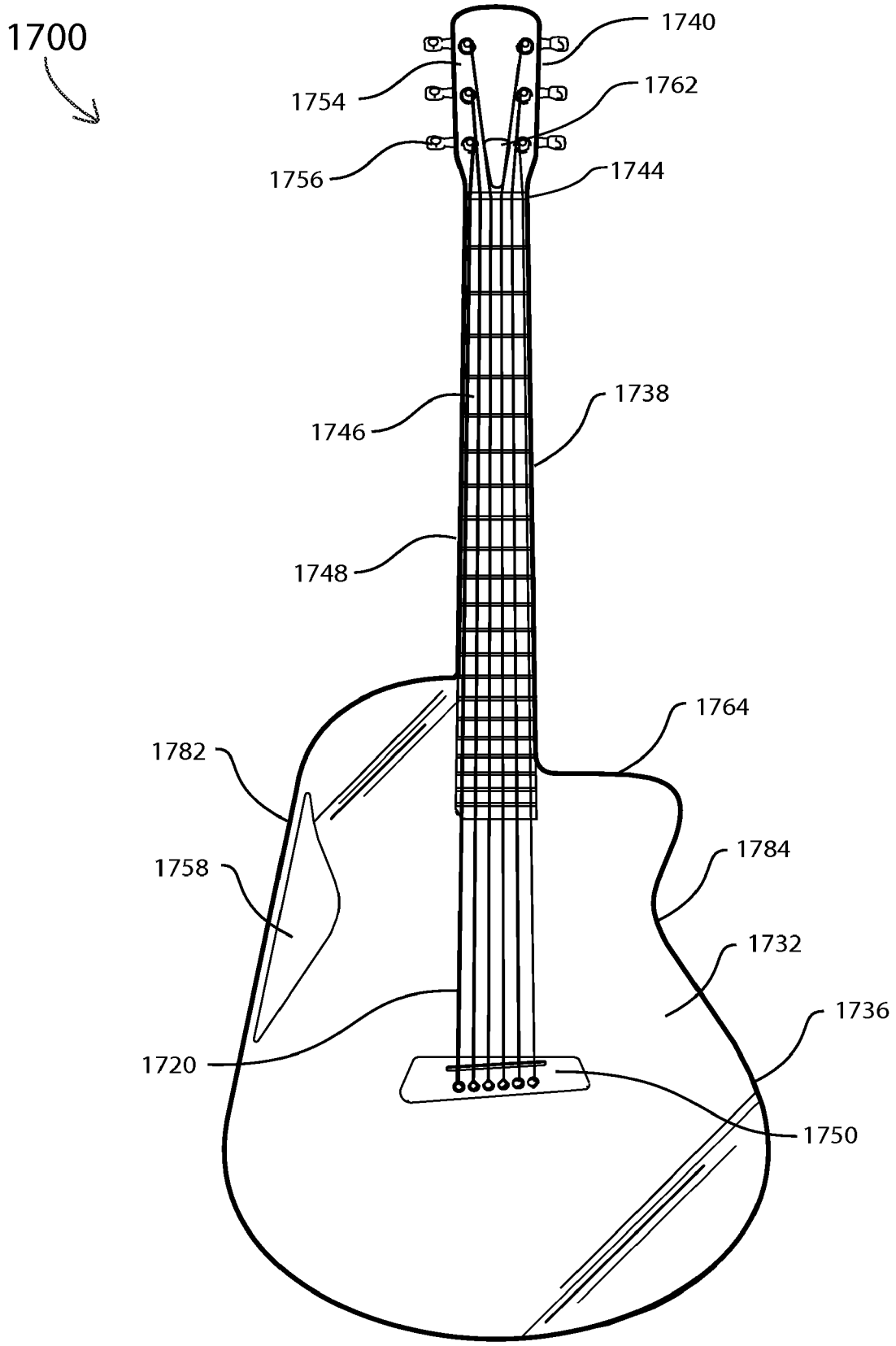
Figure 17C:
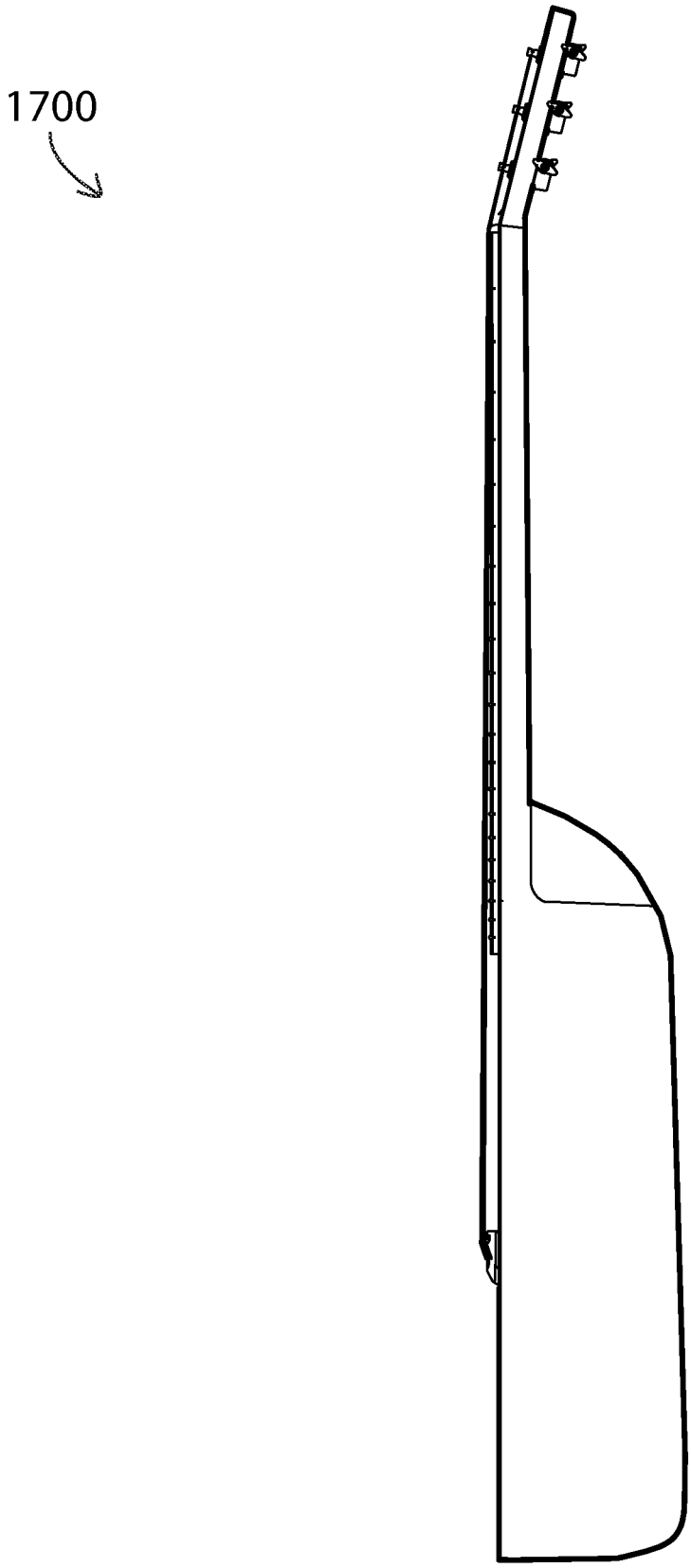

Soundboard 1732*a* can be further strengthened by adding a bridge plate 1890 to body portion 1880 thereby reinforcing soundboard 1732*a* at the location of bridge 1750 on the opposing surface of soundboard 1732*a* (see also FIG. 17B). The addition of bridge plate 1890 will minimize soundboard distortion resulting from the string tension, especially with steel-stringed instruments which can exceed 180 pounds of force between head 1740 and bridge 1750.

Person of ordinary skill in the art will understand that adding strength and rigidity to the soundboard 1732*a*, by for example adding reinforcing tubes, inhibits the ability of soundboard 1732*a* to vibrate freely. Hence it is a direct tradeoff between strength and musical response. In addition, other techniques may be used to provide structural support for body portion 1880. For example, if unitary shell 1734 is fabricated using composite manufacturing techniques, additional reinforcing materials, such as core material, described in more detail below, may be used to reinforce soundboard 1732*a*.

Referring to both FIGS. 17B and 18A, in this embodiment, sound hole 1758 is located substantially adjacent to the substantially flat side 1782 of body 1736. Because of the placement of sound hole 1758, the body portion 1880 of soundboard 1732*a* is not contiguous between the substantially concave side 1784 and the substantially flat side 1782 of body 1736, and hence body portion 1880 is substantially weaker adjacent to the substantially flat side 1782. Accordingly, body portion 1880 can be reinforced around the opening of sound hole 1758 to better handle string tension with minimal distortion. This can be accomplished by attaching an appropriately shaped reinforcing plate 1896 to create a thicker rim around the perimeter of sound hole 1758.

Alternatively, as shown in FIG. 18B, one or more reinforcing tubes, e.g., sound hole tubes 1889*a* and 1889*b*, can be added to body portion 1880 of soundboard 1732*a* to reinforce the opening of sound hole 1758. It is possible to use a single curved reinforcing tube (not shown) to reinforce sound hole 1758, instead of using one or more straight sound hole reinforcing tubes. It may also be possible to strengthen body portion 1880 around sound hole 1758 by curving the body portion 1880 thereby adding a curved lip (not shown) at sound hole 1758 that bends into the interior of instrument body 1736.

Figure 17D:
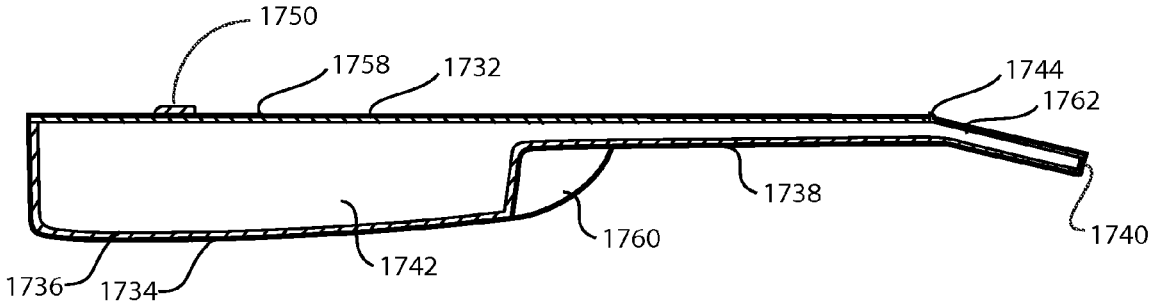
Figure 17E:
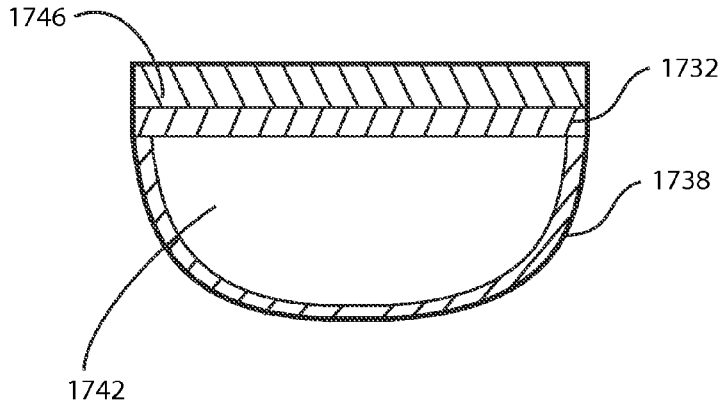

As shown in FIGS. 17B and 17D, in order to increase sound projection, head top 1754 of exemplary asymmetrical waist instrument 1700 can include supplemental sound hole 1762, located at head 1740, that communicates with cavity 1742 in the manner similar to that described above for instrument 30. Persons of ordinary skill in the art will understand that supplemental sound hole 1762 may include more than one sound hole.

Exemplary asymmetrical waist instrument 1700 can be manufactured using similar materials and methods described above for stringed instrument 30. For example, unitary shell 1734 may be formed by composite manufacturing processes, such as vacuum bagging and vacuum infusion. In such processes, unitary shell 1734 is formed with a single female mold, which allows for relatively low tooling costs verses multiple mold methods. The mold can be made of any material that will survive the curing conditions. Molds preferably are made of aluminum, composites, stainless steel, or other similar materials. The mold is typically coated with a mold-release agent, as known in the art, and is then covered with one or more layers of a fiber cloth, resin, optionally a core material, described in more detail below, and one or more additional layers of fiber cloth. The fiber cloth may include carbon, aramid, boron, silicon carbide, or tungsten fiber cloth, hemp, sesal, flax or other similar fiber cloths or combinations thereof, and the resin may include epoxy, polyester, bio-based resins, vinylester, phenolic resins, or other similar resins. It may also be possible to fabricate body 1736 by injection molding, compression molding, vacuum-forming or similar methods.

Other possible modifications to instruments 30 and 1700 include one or more sound holes (not shown) located at the sides of their respective bodies 36 and 1700, to provide acoustic feedback directed toward the musician as well as varying the shape and size of the sound hole(s) for enhanced resonance. It is also possible to vary the number of sound hole(s) on soundboards 32, 1732.

To reduce manufacturing cost, it is also possible to construct stringed instruments in accordance with the present invention wherein the soundboard only has a body portion, i.e., the soundboard does not extend substantially under the fretboard of the hollow neck. In such an embodiment, the sound cavity remains a contiguous cavity under both the soundboard and the fretboard. Note also that the neck reinforcing structures, e.g., reinforcing tubes, may or may not extend from the neck into the body portion of the soundboard.

In yet another embodiment (not shown), the asymmetrical waist includes a substantially convex side and a substantially concave side, with a sound hole located adjacent to the substantially convex side.

The asymmetrical profile advantageously retains the look and feel of a traditional instrument with a symmetrical waist, with lower waist resting on left knee of a seated right-handed musician, and vice versa, resulting in a familiar playing experience. In addition, by eliminating the concave shape of the waist, the same acoustic cavity volume can be accomplished with a smaller overall instrument size relative to conventional stringed instruments. In other words, the overall volume of the sound cavity is increased, thereby increasing resonance without the need to increase overall dimensions of the instrument. The result is a physically efficient stringed instrument with superior acoustical characteristics to a conventional instrument with similar overall dimensions.

Advantages of stringed instruments with offset sound holes include increased structural integrity because the sound hole (s) are offset from the highly stressed portion directly under the strings, thereby substantially reducing need for supplemental bracing, otherwise needed for instruments with sound holes that are inline relative to the strings. Offset sound holes also result in increased surface area available for the soundboards of instruments of similar overall sizes.

Figure 19A:
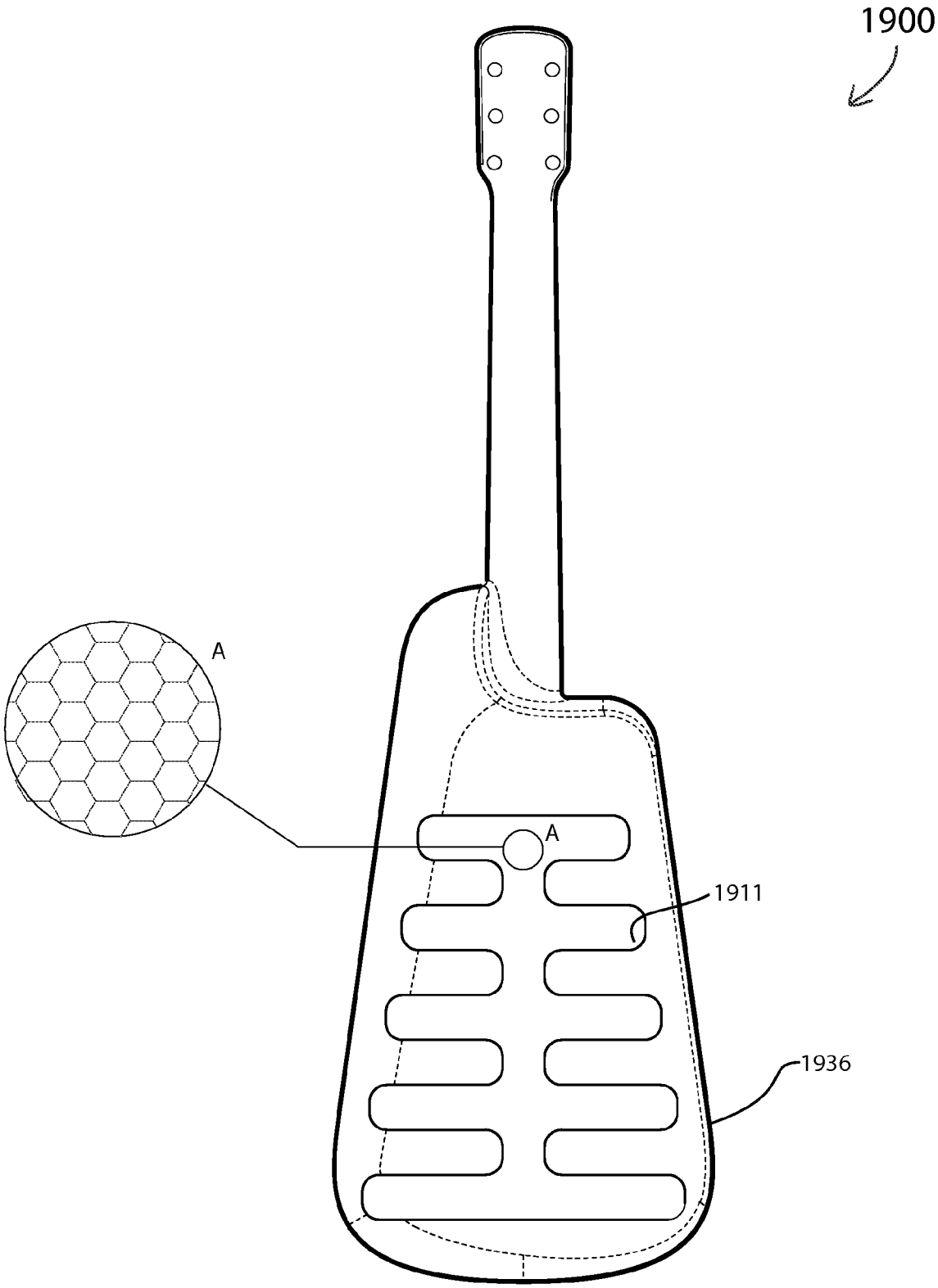
FIGS. 19A, 19B illustrate another approach for bracing the body of the stringed instrument of the present invention.
Figure 19B:
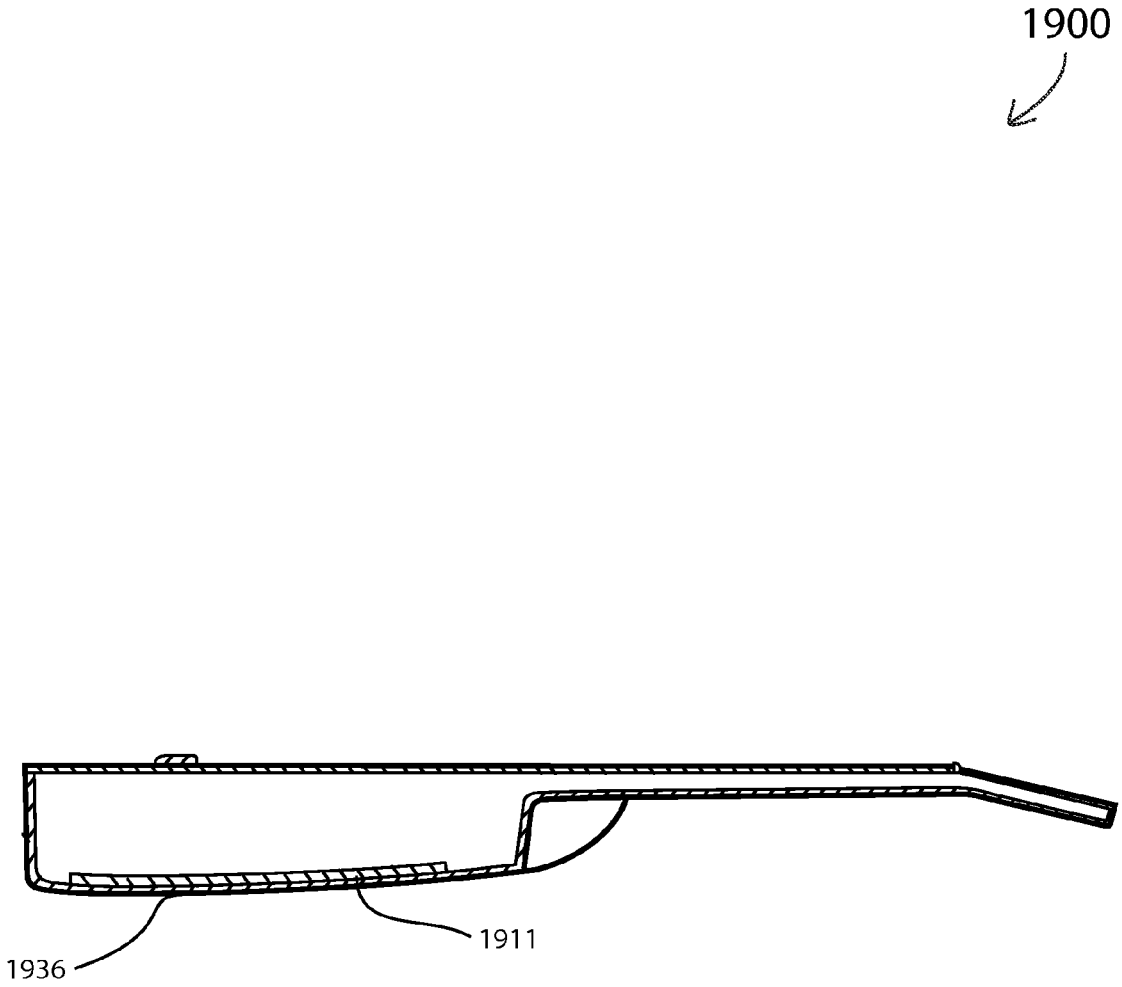
Figure 20:
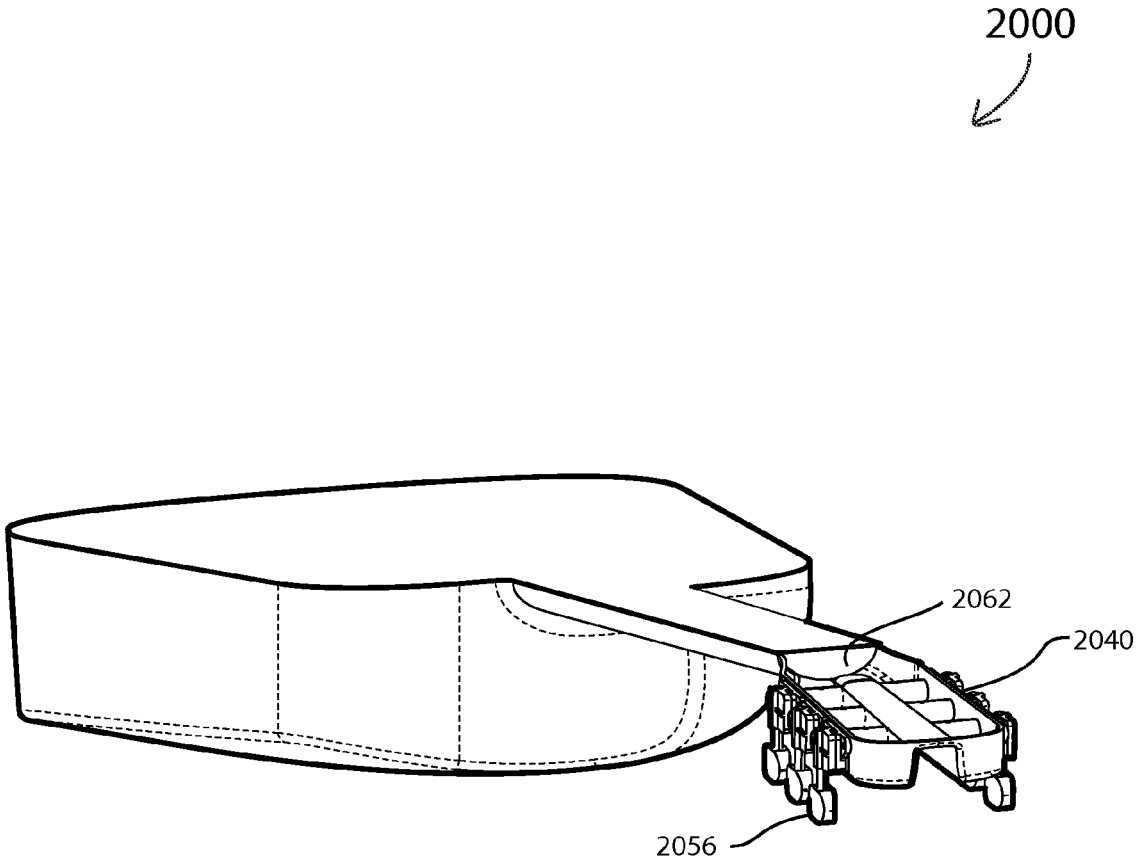
FIG. 20 is another view of the exemplary string instrument of FIG. 17A, showing the auxiliary sound hole and tuners that are suitable for instruments with steel and/or nylon strings.

FIGS. 19A, 19B are a top view and a corresponding longitudinal cross-sectional view, respectively, illustrating another approach for bracing the exemplary bodies of the stringed instruments 30, 1700, in accordance with the present invention.

In this embodiment, a core pattern 1911 is attached to the inner surface of body 1936 thereby providing selective increase in stiffness with minimal increase in weight and material. Suitable materials include Lantor Soric®, Nomex®, wood, foam and other similar materials. Those skilled in the art will understand that this body bracing approach includes other variations in the sizes, structures and patterns for pattern 1911. For example, pattern 1911 can extend up the sides of body 1936.

Other modifications to the embodiments of the present invention are also possible. For example, stringed instruments in accordance with this invention may also include an electronic pick-up which may be coupled to an amplifying device to broadcast the sound produced further.

In sum, the present invention provides an improved stringed instrument that is easy to manufacturer, easy to maintain, shock resistant, impact resistant, portable, and cost effective, with a long life, while retaining the look and feel and sounds of a high-quality traditional wooden stringed instrument.

While the present invention has been described with reference to particular embodiments, it will be understood that the embodiments are illustrative and that the inventive scope is not so limited. In addition, the various features of the present invention can be practiced alone or in combination. Alternative embodiments of the present invention will also become apparent to those having ordinary skill in the art to which the present invention pertains. Such alternate embodiments are considered to be encompassed within the spirit and scope of the present invention. Accordingly, the scope of the present invention is described by the appended claims and is supported by the foregoing description.

What is claimed is:

1. A stringed musical instrument comprising: a unitary shell having a head, a neck and a body, wherein the neck has an external cross-sectional profile configured to be substantially handheld;

a soundboard configured to be attached to the unitary shell, wherein the soundboard includes a body portion having a sound hole;

a substantially hollow cavity in the unitary shell, wherein the hollow cavity is acoustically coupled to the sound hole of the soundboard, wherein the hollow cavity extends through the head, the neck and the body, and wherein the hollow cavity extends substantially under a fingerboard; and a supplemental sound hole adjacent the head and wherein the supplemental sound hole is acoustically coupled to the hollow cavity of the unitary shell, thereby causing the hollow cavity to form an elongated resonance chamber that communicates with both the sound hole of the soundboard and the supplemental sound hole; and wherein the unitary shell includes an asymmetrical waist having a substantially flat side and a substantially concave side, and wherein the sound hole is located substantially adjacent the substantially flat side of the waist of the unitary shell.

2. The instrument of claim 1 further comprising at least one reinforcing tube disposed in the body portion of the soundboard.

3. The instrument of claim 2 wherein the at least one reinforcing tube has at least one tapered end.

4. The instrument of claim 2 further comprising a second reinforcing tube, and wherein the at least one reinforcing tube is aligned at an angle relative to the second reinforcing tube.

5. The instrument of claim 1 further comprising at least one core layer disposed in the body portion of the soundboard.

6. The instrument of claim 1 further comprising at least one core layer disposed in the body of the unitary shell.

7. The instrument of claim 1 wherein the soundboard further comprises a neck portion extending substantially from the body towards the head of the unitary shell.

8. The instrument of claim 1 further comprising at least one reinforcing plate disposed in the body portion of the soundboard and around a perimeter of the sound hole.

9. The instrument of claim 1 further comprising at least one reinforcing tube disposed in the body portion of the soundboard and substantially along a perimeter of the sound hole.

10. The instrument of claim 9 wherein the at least one reinforcing tube has at least one tapered end.

11. The instrument of claim 1 further comprising at least one reinforcing tube disposed in the body portion of the soundboard.

12. The instrument of claim 11 wherein the at least one reinforcing tube has at least one tapered end.

13. The instrument of claim 11 further comprising a second reinforcing tube, and wherein the at least one reinforcing tube is aligned at an angle relative to the second reinforcing tube.

14. The instrument of claim 1 further comprising at least one core layer disposed in the body portion of the soundboard.

15. The instrument of claim 1 further comprising at least one core layer disposed in the body of the unitary shell.

16. The instrument of claim 1 wherein the soundboard further comprises a neck portion extending substantially from the body towards the head of the unitary shell.

17. The instrument of claim 1 further comprising at least one reinforcing plate disposed in the body portion of the soundboard and around a perimeter of the sound hole.

18. The instrument of claim 1 further comprising at least one reinforcing tube disposed in the body portion of the soundboard and substantially along a perimeter of the sound hole.

19. The instrument of claim 18 wherein the at least one reinforcing tube has at least one tapered end.

* * * * *